US005651417A

United States Patent [19]

Coughlin

[11] Patent Number: 5,651,417

[45] Date of Patent: Jul. 29, 1997

[54] BASE FOR A FIRE-FIGHTING TOOL

[76] Inventor: Jerome A. Coughlin, 1972 Robin Ct., Bethlehem, Pa. 18015

[21] Appl. No.: 345,617

[22] Filed: Nov. 28, 1994

Related U.S. Application Data

[62] Division of Ser. No. 863,952, Apr. 6, 1992, Pat. No. 5,368,106.

[51] Int. Cl.[6] ..... A62C 8/00

[52] U.S. Cl. ..... 169/51; 169/70; 182/109; 239/271; 239/276; 248/357

[58] Field of Search ..... 169/51, 70; 239/271, 239/276; 182/109, 111; 248/188.8, 188.9, 357

[56] References Cited

U.S. PATENT DOCUMENTS 4,073,454 2/1978 Sauber ..... 248/188.8 X
4,462,319 7/1984 Larsen ..... 169/28 X
5,154,255 10/1992 Kiska et al. ..... 182/111

*Primary Examiner*—Andrew C. Pike
*Attorney, Agent, or Firm*—Charles A. Wilkinson

[57] ABSTRACT

Base for a fire-fighting tool is adapted to be secured to a horizontal surface such as the deck of a ship next to a vertical surface such as a bulkhead of such ship. The base is disposable at an angle that will allow the tip of a penetrator of a nozzle section of the fire-fighting tool, upon activation of an extensible hydraulic ram attached to the nozzle section, to be forced into the bulkhead and ultimately through the bulkhead, after which water may be sprayed into the area behind the bulkhead where a fire may be burning via spray orifices in the nozzle section. The arrangement of the fire-fighting tool at an angle between the deck and the bulkhead assures that there will be a rigid surface available for enabling pressure of the hydraulic ram to be exerted forcefully enough on the end of the penetrator section to breach the wall or bulkhead. The penetrator will dig into the wall surface efficiently and effectively even though it is applied to such wall surface at an angle.

5 Claims, 8 Drawing Sheets

FIG. 10
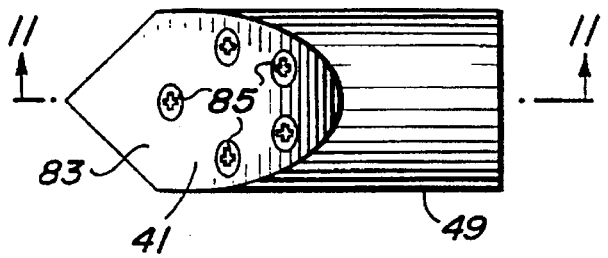
FIG. 11
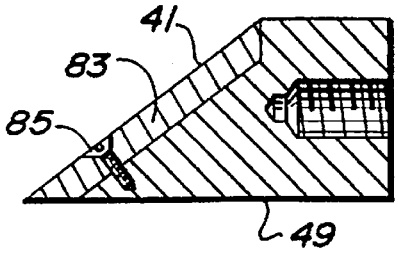
FIG. 12
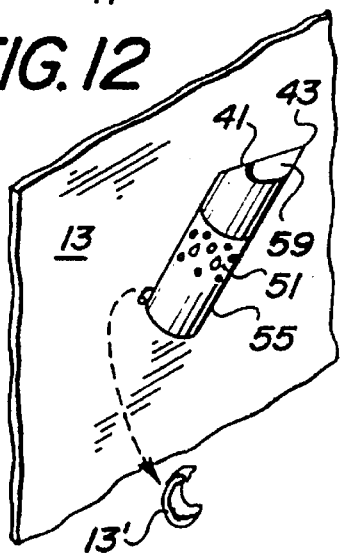
FIG. 13
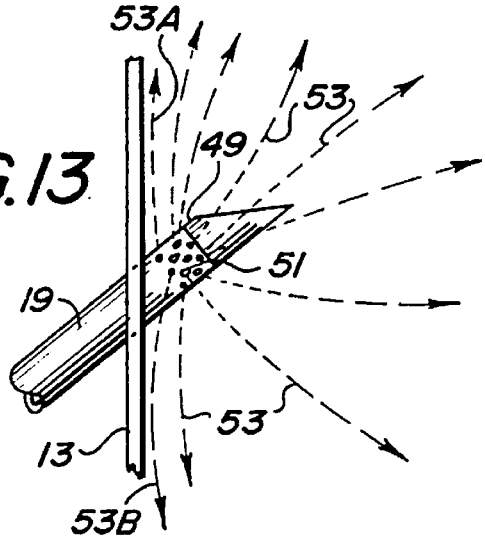
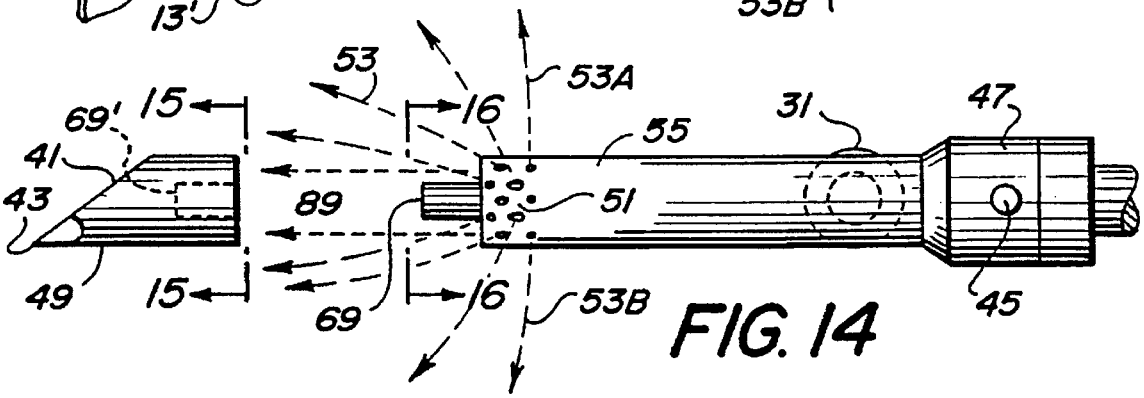
FIG. 14
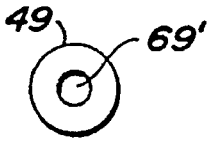
FIG. 15
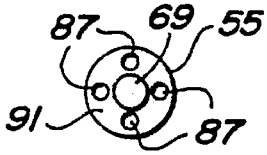
FIG. 16
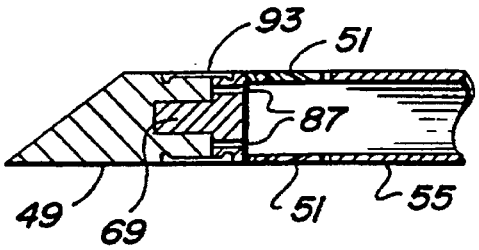
FIG. 17

BASE FOR A FIRE-FIGHTING TOOL

RELATED APPLICATIONS

This application is a division of U.S. application Ser. No. 07/863,952 filed Apr. 6, 1992, now U.S. Pat. No. 5,368,106 issued Nov. 29, 1994.

BACKGROUND OF THE INVENTION (1) Field of the Invention

This invention relates generally to fire fighting and, more particularly, to a special nozzle and appended equipment for punching through walls, bulkheads, and the like to allow water or other fire quenchants or inhibitory materials to be sprayed or otherwise distributed on the opposite side of the wall or bulkhead. More particularly still, the invention relates to an apparatus for punching through quarter-inch or thicker steel plate to allow a spray nozzle to be positioned on the opposite side of such plate or bulkhead to attack a fire.

(2) Description of the Prior Art

In the fighting of fires, fire personnel frequently find the fire or the principal locus of the fire behind a wall, bulkhead, or other barrier which prevents easy access to such fire. One of the uses of the ubiquitous fireman's ax was, and still is, to breach various of these barriers such as doors and walls in residences and business establishments to enable the firemen to gain access to the fire. It is a toss up, in fact, whether the fireman's ax is used more frequently to chop holes in roofs and the like in order to release heat and toxic fumes from a fire in a relatively harmless direction, or whether the ax is used more frequently to breach barriers which prevent the fireman from having access to the fire.

It was early suggested that it would be advantageous to have a hose nozzle which could itself be forced through a wall or the like without first making a hole with another implement, particularly so that quenchant could be injected behind the wall or the like without exposing the fireman to the heat of the fire behind such wall as well as preventing access to the fire by oxygen in the air on the cool side of the barrier. One of the first suggestions for such a fire tool was U.S. Pat. No. 1,644,290 issued Oct. 4, 1927 to L. R. Titcomb et al. The Titcomb device comprised a rotatable drill-type hose nozzle having spiral ridges on the nozzle for, in effect, drilling through a wall or the like, and orifices in the spiral section to allow water to be injected through the wall after the wall was breached by the drilling operation. The Titcomb drill was manually operated.

U.S. Pat. No. 2,413,083, issued Dec. 24, 1946 to W. E. Snowden et al., discloses an injection nozzle also for manual injection, particularly through aluminum or magnesium alloy sheet metal surfaces such as the skin of an airplane and the like. External fins or ribs which aid in rupturing or breaching such light sheet metal are positioned on the exterior of the nozzle. Slanted orifices for fire quenchant are provided in the sides of the nozzle which has a conically pointed head.

U.S. Pat. No. 2,732,017, issued Jan. 24, 1956 to J. B. Fleming, discloses a further type of extinguishing device, particularly for use in extinguishing burning tires on trucks which have become ignited through friction with the road, particularly when deflated. The device is designed to be forced through the tire by manual pressure and includes a foot-receiving shoulder upon which force may be applied by the foot to puncture the wall of the tire. The injection tube has a slanted end to facilitate puncturing the side wall of the tire; and in at least one view, the device is shown being inserted into the tire at an angle, mainly, it appears, as a result of holding the device in the hand while applying foot pressure to the bottom portion. Fire fighting material such as $CO_2$ is injected directly into the tire from the end of the tube which is thrust through the tire side wall.

U.S. Pat. No. 2,756,829, issued Jul. 31, 1956 to J. D. Phillips, discloses another device for extinguishing fires in tires in which the extinguishing material is injected into the tire after the side wall of the tire is punctured by a spear-type point on the end of the device. The spear-type point of the Phillips device comes to a sharp central point.

U.S. Pat. No. 2,813,753, issued Nov. 19, 1957 to F. C. Roberts, discloses a fog nozzle for fire-fighting incorporating a slanted or beveled end through which an orifice passes and a series of inclined orifices on the sides, each of which exit into a round orifice oriented straight out from the surface of a conical portion of the nozzle. The fire-fighting fluid passing from the interior orifice into the outer orifice is broken up into small droplets which serve to form a fog within a chamber into which the nozzle has penetrated. The forward end of the nozzle is referred to as defining a "chisel portion of the nozzle used to break plaster, board, glass or the like when the nozzle is penetrated through a wall or the like". The nozzle is apparently thrust manually through a wall or other barrier.

U.S. Pat. No. 2,857,005, issued Oct. 21, 1958 to D. E. Medlock, discloses an apparatus for injecting fire-fighting fluid within the fuselage of an aircraft. The apparatus includes a rotating drill-like nozzle having orifices in its wall. It is stated that the drill portion of the tool should be formed from some rugged material such as tool steel or the like.

U.S. Pat. No. 3,865,194, issued Feb. 11, 1975 to J. F. Chatfield, Jr., discloses a drill-type fire fighting apparatus for breaching the walls of buildings and the like. A rotary cutting bit on the end does the actual breaching of the wall. More or less straight forward fluid orifices are provided in the end.

U.S. Pat. No. 4,147,216, issued Apr. 3, 1979 to R. W. Schnepfe et al., discloses a penetrant or nozzle arrangement particularly for fires in aircraft and the like. The device includes a cutter mounted concentrically with the nozzle which is initially forced forward to breach the light metal skin of the aircraft.

U.S. Pat. No. 4,219,084, issued Aug. 26, 1980 to N. C. Gray et al., discloses a fire-fighting nozzle assembler having a forward conical penetrator, a cylindrical spray orifice section to which the penetrator is attached, and a series of ribs or handles to be grasped by the user to be able to obtain sufficient force to press the nozzle assembly through the aluminum or other light metal skin of an aircraft. Different nozzles may be used on the end to obtain various spray patterns. An integral movable weight associated with the nozzle is used to, in effect, hammer through the aluminum or other light metal skin of an aircraft or the thicker but still light metal skin of a spacecraft.

U.S. Pat. No. 4,271,909, issued Jun. 9, 1981 to J. F. Chatfield et al., discloses a hydraulically operated tool which can use various cutting implements at the end to give access to a fire location. The tools are either rotated or reciprocated by the fluid pressure and include reciprocating chisel arrangements.

U.S. Pat. No. 4,625,808, issued Dec. 2, 1986 to P. F. Halfpenny, discloses an arrangement for breaching the light metal skin of an aircraft including an explosive penetrator and the like.

U.S. Pat. No. 4,676,319, issued Jun. 30, 1987 to R. H. Cuthbertson, discloses a fire-fighting apparatus for use with aircraft and the like to breach the light metal wall of the aircraft. The tip of the device may rotate and is provided with a sharp end with a water or quenchant nozzle in between the end and the angled orifices, as shown, and quenchant or other fluid-type fire-fighting material is injected into the aircraft through a hollow, sharp-pointed penetrator means. There are both inclined and straight through quenchant orifices. In one embodiment, the end of the tool is forced through the light metal skin of an aircraft or the like by a reciprocating impact motion.

U.S. Pat. No. 4,697,740, issued Oct. 6, 1987 to E. W. Ivy, discloses a mist generator having a tapered or beveled outer penetrator or piercing section described as comprising a truncated cylinder having an elliptically shaped beveled surface. The water quenchant may be broken up into a mist by a rotating inner perforated member. The piercing operation is manually performed.

U.S. Pat. No. 4,802,535, issued Feb. 7, 1989 to A. N. Bakke, discloses a hand-held nozzle having a sharp end for punching through light walls and the like. The device has a conical end and may include special handles for manipulation. There is a separate hard conical end and the orifices in the sides of the apparatus are set at various differential angles so as to gain a uniform flow of quenchant liquid in the device.

U.S. Pat. No. 4,832,265, issued May 23, 1989 to R. Anfosso et al., discloses a percussion-type perforator injector for breaching relatively strong walls which is intended not only for fire fighting, but also for use by public order officers.

As will be seen from the above-cited references, a number of devices have been devised for the injection of water or other quenchant materials to the interior of a building or the like after a breach has been made by the devices themselves. None of the devices of the prior art are adapted, however, for breaching relatively heavy wall or bulkhead material such as a steel plate having a quarter-inch thickness or more. None of the apparatus, so as the inventor is aware, is effective in punching through more than three-sixteenths (3/16ths) inch steel plate or, in most cases, even considerably thinner material or even metals with considerably less inherent strength. Since the bulkheads in many or most naval vessels as well as civilian vessels are customarily formed from quarter-inch steel plate, the heretofore available penetrator nozzles have been unsatisfactory for shipboard use in particular and have, therefore, not even been made available. There is a need, therefore, for an apparatus which will easily breach a quarter-inch plate to inject on the other side a fluid used in the quenching of fire. There has been a clear need, therefore, to provide a penetrating fire nozzle which will penetrate normal quarter-inch plate, which is a standard material for the bulkheads dividing compartments on shipboard as well as in other uses. There is a further clear need for the provision of an apparatus and apparatus system that may be used to punch through a steel bulkhead or similar material or, in fact, any heavy material up to and including a half-inch or more of plate steel.

One of the difficulties in piercing heavy barriers of any nature under fire conditions is that even when a tool sufficiently rugged to punch through the barrier is available with sufficient power to apply the force necessary, there is usually no way to brace the device to allow a significant force to be applied to the surface. A fireman leaning against a punch, for example, or even several firemen leaning against a punch, is severely limited in the amount of force which can be applied. The force ultimately available, for example, depends basically upon the mass of the firemen. This is relatively negligible when dealing with a steel barrier or the like. The force available can be increased basically by applying additional momentum or dynamic force along with static force to the punch. This course has been followed by several of the prior references cited above. However, such expedient also has strict limitations.

In spite of the above difficulties in many environments, and particularly on shipboard, there is invariably a solid surface relatively close by. On shipboard, this is usually the adjacent deck, and in other environments, the floor of a building or the ground surface. The deck, however, while close by, is also at right angles so that it is difficult to brace against it without slippage along either the deck or the adjacent bulkhead. The adjacent deck or ground surface, therefore, has not been considered to be a practical bracing medium. The present inventor, however, has unexpectedly found that with a properly arranged tool, the expected slippage and bending damage to the tool itself does not occur and with the proper design use of the adjacent deck as a bracing surface, very high pressure can be applied to a section of bulkhead sufficient to penetrate relatively heavy or thick barriers.

OBJECTS OF THE INVENTION

It is an object of the present invention, therefore, to provide a fire-fighting nozzle having the ability to puncture a steel plate up to or more than a quarter-inch thick.

It is a still further object of the invention to provide an apparatus which will breach a quarter inch of steel plate or more, particularly on shipboard, when it is desired to reach a fire within a compartment.

It is a still further object of the invention to provide a fire nozzle designed to breach a steel plate while supported at a substantial angle to said plate and while bracing against an adjacent perpendicular surface.

It is a still further object of the invention to provide a fire-fighting nozzle having a hardened steel tip with a special design which enables such tip to thrust through a steel plate having a thickness of at least one-quarter inch when the nozzle is placed under considerable compressive force such as by an extendable hydraulic ram or the like.

It is a still further object of the invention to provide a fire-fighting nozzle sufficiently sturdy to punch through a steel plate one-quarter-inch thick or more and having a separate tip which may be removed to allow equal spread of fire-fighting quenchant within an interior chamber.

It is a still further object of the invention to provide a fire-fighting nozzle having a penetrator at the outer end arranged and constructed so that such penetrator may be detached from the nozzle by the pressure of quenchant liquid within the apparatus, increasing the ultimate efficiency of distribution of quenchant within the chamber.

It is a still further object of the invention to provide a self-penetrating fire-fighting nozzle from which liquid quenchant may be sprayed in an equal pattern even though the nozzle itself is positioned at an upward angle.

It is a still further object of the invention to provide a fire-fighting system in which a series of penetrator nozzles can be punched through a barrier and attached to a flow of quenchant liquid for spraying quenchant beyond the barrier while additional penetrator nozzles are being thrust through the barrier using the same ram or other power source.

It is a still further object of the invention to provide a method of penetrating a heavy structural barrier, while held at a substantial angle to such barrier to enable the opposite end of the device to be braced upon another surface at right angles thereto.

It is a still further object of the invention to provide a base upon a fire-fighting tool which will stabilize the position of the tool upon a supporting surface adjacent and substantially perpendicular to a surface which is to be penetrated.

It is a still further object of the invention to provide a system for gaining access to fire conditions beyond a heavy steel barrier by punching through said steel barrier at an angle while bracing at least partially against a substantially perpendicularly or horizontally disposed bracing surface.

It is a still further object of the invention to provide a system for gaining access to fire conditions beyond a heavy metal barrier, such as in the interior of a shipboard compartment, by the use of an angled fluid pressure ram, a non-slip base and a combined penetrator and spray nozzle adapted for punching through the heavy metal barrier at a substantial angle enabling bracing against a nearby perpendicular surface.

Other objects and advantages of the invention will become evident from attention to and review of the following disclosure in conjunction with the appended drawing figures.

SUMMARY OF THE INVENTION

This invention provides a fire nozzle assembly equipped with a preferably hardened steel penetrator having a special design attached to the front of said nozzle. The apparatus of the preferred embodiment incorporates a beveled end on the front of the penetrator intersecting with two beveled cutting planes generally on opposite sides of the bottom forward section of the penetrator. The three intersecting beveled cutting planes form a pointed end on the penetrator, or in one embodiment, a sharp edge on the end. The penetrator of the invention is used at a substantial angle with the plate material to be penetrated preferably intersecting with such material at an angle of about 35°. Force upon the penetrator is preferably provided by a fluid pressure ram which intersects with an adjacent perpendicular surface at an angle of about 55°. The pentrator is forced into and through a bulkhead or wall by the fluid pressure extension ram braced against the deck or other horizontal surface adjacent to the more or less vertical wall or bulkhead which is to be penetrated, which horizontal surface provides the mass or rigidity to enable substantial force to be applied to the penetrator by the ram. A preferred base for the extension ram provides a flat surface which contacts the horizontal bracing surface at the preferred angle for operation of the ram for penetrating the vertical wall or bulkhead and a downwardly inclined tooth or teeth on the bottom which pierce the horizontal surface and stabilize the position of the base. The shape and action of the teeth on the base are basically similar to those of the tip or point on the penetrator. Other arrangements for stabilizing the base may also be used. The system of the invention is particularly effective in fighting shipboard fires and the like where a heavy wall or similar barrier may need to be breached to reach the fire.

BRIEF DESCRIPTION OF THE DRAWINGS

FIG. 10 is a top view of an alternative embodiment of the penetrator of the invention in which a hardened steel or other material insert seated in a seat on top of the penetrator section provides the toughness and hardness to breach a one-quarter inch or more steel wall.

FIG. 11 is a side sectional view taken upon plane 11—11 of the end of the penetrator shown in FIG. 10 showing how the hardened carbide insert is held in its seat by the set screws.

FIG. 12 shows a nozzle of the invention extending through a plate with the spray orifices extending through the plate prior to the water being turned on to produce sprays extending out in all directions from the nozzle and also showing a slug of metal cut from the plate falling away from the penetrator.

FIG. 13 is a side view of the nozzle shown in FIG. 12 extending through the plate with the quench sprays turned on and arrows indicating the essential direction of dispersion of the sprays.

FIG. 14 is a side view of an alternative nozzle arrangement in accordance with a preferred embodiment of the invention partially disassembled to show the detachment or forcing off of the penetrator section by forceful water sprays extending from the end of the nozzle.

FIG. 15 shows a bottom view taken upon plane 15—15 of the back of the penetrator section shown in FIG. 14.

FIG. 16 is a front view taken upon plane 16—16 of the end of the nozzle shown in FIG. 14 showing the spray orifices in the end.

FIG. 17 is a sectional side view of an alternative arrangement of the embodiment of the nozzle assembly shown in FIGS. 14 to 16.

DESCRIPTION OF THE PREFERRED EMBODIMENTS

As indicated above, a number of prior inventors have developed self-penetrating nozzles, particularly for breaching the walls of residences, or business or industrial establishments, when there is a fire condition inside, or the fuselage of an airplane which has crashed. Workers have also adapted these previous designs to punch through light steel plate of up to perhaps 3/16ths of an inch using a hand-held pneumatic hammer or in some experimental trials a braced hydraulic ram. However, many bulkheads, particularly in ships, are formed from one-quarter inch steel plate and the previous devices have, therefore, not been effective in ships, except those constructed out of the very thinnest sheet material. The structural plates used for naval ships, however, are usually formed from at least quarter-inch steel plate and have, therefore, not been pierceable at all by previously available apparatus of this type. The present inventor has discovered that with the proper shape of the penetrator, and the use of extension ram apparatus arranged such that the penetration is made at an angle upwards along the bulkhead with the lower base or leg of the ram stabilized, or effectively held in place, that a very effective, quick breaching of the bulkhead can be effected and a hose nozzle quickly and effectively implanted in such bulkhead, whereupon water sprays can be quickly and efficiently applied to the opposite side of the bulkhead to squelch fire conditions.

Figure 1:
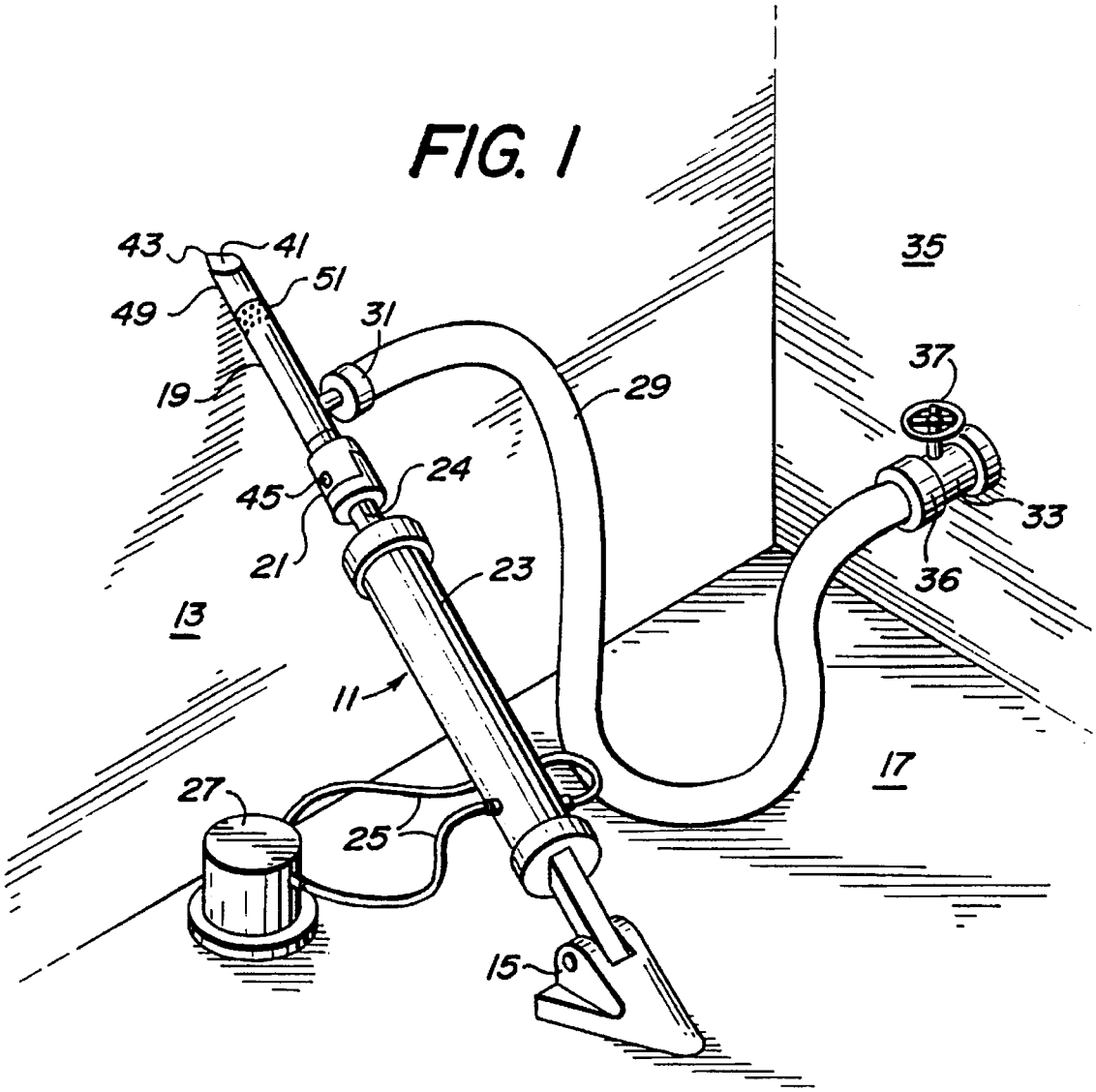
FIG. 1 is an isometric view of the penetrating nozzle assembly of the present invention arranged to punch through a bulkhead on a ship such as a naval vessel.

Referring more particularly to the appended drawings, FIG. 1 is an isometric view of the fire-fighting system of the invention including an apparatus or fire-fighting tool indicated generally as 11 set up adjacent to a ship's bulkhead 13 which it is desired to breach in order to spray fire-quenching materials on the opposite side. As will be seen in FIG. 1, the fire-fighting tool 11 rests on a base 15 in contact with the deck 17 adjacent to the bulkhead 13. A nozzle 19 is attached by a fitting or pinned connection 21 to a fluid pressure extendible ram unit 23 which is preferably a hydraulic ram which can apply at least 15,000 pounds of pressure between the base 15 and the fitting 21. Rams having a capacity of up to or more than 25,000 pounds of pressure can be effectively used. The extendible ram 23 is attached by a flexible armored tubing 25 to a portable hydraulic pump 27 or other fluid pressure source which may be any reliable hydraulic pump. As will be understood by those familiar with hydraulic extension rams, a relatively small pressure of several hundred or a thousand pounds pressure from the pump 27 applied to the ram may be easily converted into a force of over 15,000 pounds pressure by the multiplication factor of the ram. A fire hose 29 is connected by a reducing fitting or adaptor 31 to the side of the nozzle 19 and at the other end by a fitting 36 to a hydrant 33 or other fluid source which is shown protruding from a second bulkhead 35. A valve 37 may open or shut off the flow of liquid from the agent source or hydrant 33.

Figure 2:
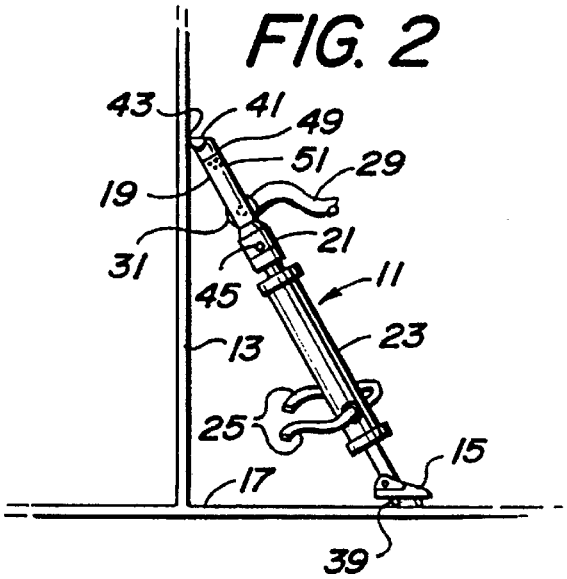
FIG. 2 shows a side elevation of the self-penetrating nozzle of the invention placed in position just before extension of the ram to force the penetrator and base into the adjacent steel plates.

FIG. 2 shows the apparatus of FIG. 1 in a vertical side view placed against the bulkhead 13 as in FIG. 1 and against the deck 17, also as in FIG. 1. It will be seen in FIG. 2 that the base 15 has a tooth or preferably several teeth or sharp tips 39 on the lower surface. The angle of the side of the tooth 39 is a reciprocal, or complement, of the angle of a beveled cutting plane or surface 41 at the top of the nozzle 19 which beveled cutting plane 41 comes to a sharp point 43 as shown more clearly in FIG. 1. The fitting or connection 21 as shown in FIG. 2 is a pin-type fitting in which a pin 45 passes through a clevis 47 as more clearly shown in FIGS. 5 and 6.

It should be understood that in FIG. 2 the fire-fighting tool 11, as a whole, is placed in position at the angle in which it will be operated to force an opening or passage in the bulkhead 13, but that the device is not as yet operated as shown in FIG. 2. In other words, as shown in FIG. 2, the extensible ram 24, see FIGS. 1 and 3, has not extended because no pressure has been applied to the ram cylinder 23 through the armored pressure hose 25.

As will be quite familiar to those skilled in the hydraulic arts, a hydraulic extension ram can be designed to apply almost any force desired to the ram itself from a relatively small pressure cylinder or pump. In the operation of an extension ram, a pump will apply a force equal to the force upon the pump cylinder which when applied to the interior of a larger cylinder by an interconnecting passage will apply to the larger cylinder a force equal to the pressure per square inch multiplied by the area of the piston in the larger cylinder. A back valve system will prevent the fluid in the larger ram from draining away with each stroke of the pump and a reservoir provides fluid to allow progressive movement of the large ram.

Figure 3:
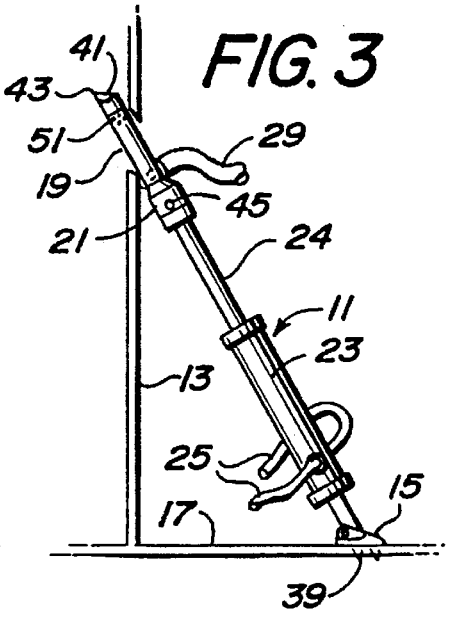
FIG. 3 is a view similar to FIG. 2 but in which the extension ram has been activated and forced the nozzle through the bulkhead and the tooth or teeth of the base into the deck.

In FIG. 3, the same fire-fighting tool 11 as shown in FIG. 2 has been operated with the results shown. As shown in FIG. 3, the tooth or teeth 39 on the base 15 have been forced or implanted into the deck 17 effectively "stabilizing" the base, i.e., preventing it from moving or sliding on the deck, so that it will not slip in a direction counter to the bulkhead 13 and, at the same time, the point 43 of the nozzle 19 has been initially forced partially into or through the bulkhead 13 so that such point also will not slip up the bulkhead. Continued additional pressure has then been applied to the extensible ram 23 until the penetrator portion or outer portion 49 of the nozzle has been forced completely through the bulkhead 13 as shown in FIG. 3. After the penetrator portion 49 of the nozzle 19 has been forced through the bulkhead 13 sufficiently so that the orifices 51, which comprise small openings in the sides of the nozzle, preferably at several differential angles, clear the bulkhead, the water or other quenchant supply from the hydrant 33 in FIG. 1 is turned on so that water exits from the nozzle 19 through the orifices 51 as water sprays 53, shown more particularly in FIG. 13, directed beyond the bulkhead 13 to where it is assumed that fire conditions prevail. It will be noted that the water sprays 53 extend in all directions, including upwardly and downwardly, more or less parallel to the bulkhead 13 and also outwardly away from the bulkhead. The spray orifices 51, in other words, are arranged at differential angles which direct the sprays in various directions into the compartment beyond the bulkhead 13, but not back against the bulkhead. This requires that the orifices 51 be differentially angled to take into account the initial angle of the nozzle 19 with the bulkhead 13. If the spray angle from the nozzles 51 were evenly distributed and angled about the nozzle 19, the water sprays at the top of the nozzle would spray back on the bulkhead 13 being thereby essentially wasted, except for the cooling effect they may have on the bulkhead, and the water sprays at the bottom of the nozzle 19 would spray away from the bulkhead 13 at the same angle or substantially the same angle at which the nozzle 19 has penetrated the bulkhead 13. This also would normally be undesirable since it is usually desired to evenly fill the space beyond the bulkhead with an even spray of cooling and quenching water or other fire-fighting agent to completely envelope the compartment beyond the bulkhead, or, if such compartment is very large, to at least evenly envelope the area or volume around the nozzle itself in water sprays. Such an enveloped area may often allow opening of a bulkhead door at such point for direct access of fire or damage control personnel to the fire or even entrance in protective clothing into the area.

Figure 4:
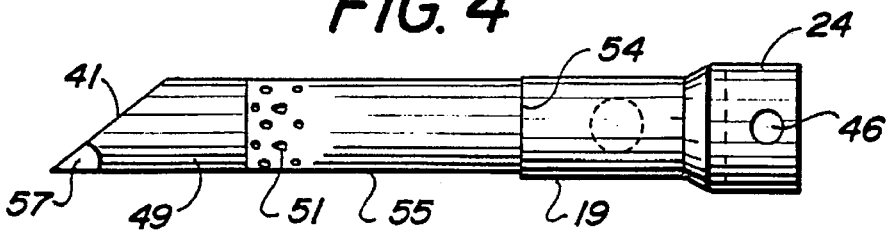
FIG. 4 shows a side view of the nozzle assembly of the invention.
Figure 5:
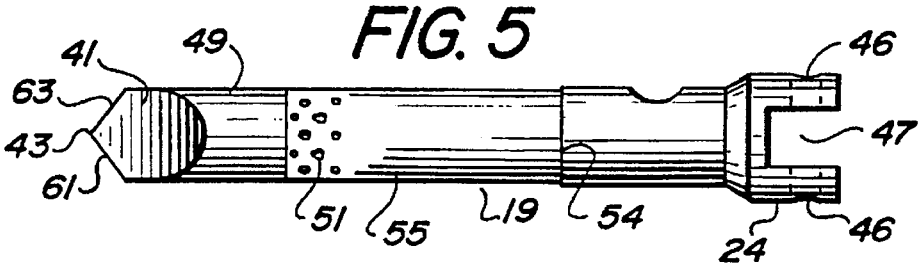
FIG. 5 shows a top view of the nozzle assembly of the invention and FIG. 6 shows a bottom view of the nozzle assembly of the invention shown in FIG. 4.
Figure 6:
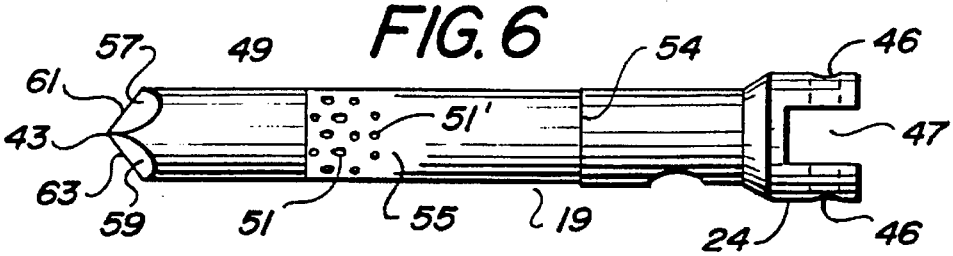

FIG. 4 is a side view of the nozzle 19 shown in FIGS. 1 through 3. It will be seen in FIG. 4 that the nozzle 19 comprises a central section 55 which constitutes the spray section, a forward section 49 which constitutes the penetrator section, and the rear section 21 which is an attachment or fitting section and comprises, in the particular embodiments shown, a clevis 47 which may be attached to the ram 24 of the extension ram 23 through a pin 45 in the pinhole or orifice 46. The orifice, spray, or nozzle section 55, or the central section 55 of the nozzle 19, is provided towards the upper end with orifices 51 spaced about the nozzle from which water or other sprays extend during spray use. The penetrator section 49 of the nozzle 19 may constitute an integral continuation of the central nozzle spray or orifice section 55 or may constitute a separate section. The preferred form of the invention shown in FIGS. 4, 5, and 6 provides a separate penetrator section 49 as shown more particularly in FIG. 7. The penetrator section 49 is provided with a flat beveled cutting plane 41 at approximately a 35° angle with the longitudinal axis of the nozzle. The 35° flat bevel or cutting plane may be considered to be on top of the nozzle section or penetrator section and, in fact, in use the 35° bevel will be placed on top and will as a rule of thumb be positioned so that such bevel or cutting plane is essentially horizontal. This effectively sets the correct angle of the penetrator section for penetration of the bulkhead 13, although some variation in the angle can be tolerated. A top view of the nozzle section shown in FIG. 4 is shown in FIG. 5 where it can be seen that the end of the penetrator section comes to a sharp point 43 as indicated also in FIG. 1. The sharp point 43 is formed by two further relieved beveled cutting planes 57 and 59 in the surface of the penetrator section which are provided in the bottom section, see FIG. 6, of the nozzle penetrator section 49 or nozzle assembly section 19. The cutting planes 57 and 59 intersect with the sides of the flat cutting plane 41 on the top of the penetrator section 49 and interact together with the cutting plane 41, since both the planes 57 and 59 and 41 are flat, to form straight cutting edges 61 and 63 extending backwardly and upwardly along the penetrator section. It is interaction of these three beveled cutting planes plus the sharp point on the end, i.e., point 43 on the end of the penetrator section, which interact to pierce the steel of the bulkhead and part or punch out the steel as the penetrator section followed by the upper portion of the nozzle section passes through the bulkhead.

Figure 23:
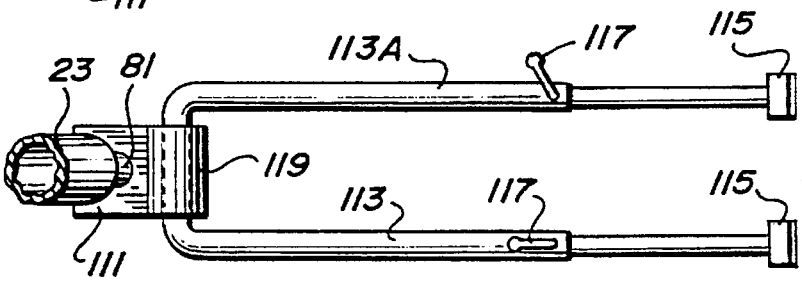
FIG. 23 is a plan view of the embodiment of the invention shown in FIG. 22.

In FIG. 6 it may be noted that there are three additional spray orifices 51' on the bottom of the nozzle section 55. These additional spray orifices add a further spray to the bottom of the nozzle and compensate for the angle at which the nozzle passes or extends through the bulkhead. Alternatively the spray orifices might be provided in a slanted arrangement such as shown in FIG. 23 with respect to a slot configuration.

It will be understood that it is necessary for the flat beveled cutting plane 41 to be on top of the penetrator section 49 when the nozzle 19 is placed against the bulkhead 13 and pressure applied by the ram 23. Otherwise, it has been found, the point of the fire-fighting tool represented by the point 43 of the penetrator section 49 will merely slide up along the bulkhead rather than piercing the bulkhead.

The cutting edges 61 and 63 and, in fact, the edges of the cutting plane 41 all around, should be kept sharp either by the use of new penetrators or the liberal use of a honing stone along the edge so that a slug of metal will be punched from the bulkhead as the penetrator passes through. Usually the metal is first cut by the lower forward edge of the cutting plane 41 and the metal slug section rolled up as the penetrator passes through. As will be seen in FIG. 12, when the metal slug or roll of metal arches back sufficiently to contact the far surface of the bulkhead, the metal roll tends to tear off at the bottom adjacent to the top of the penetrator and falls down to the foot of the bulkhead.

Figure 7:
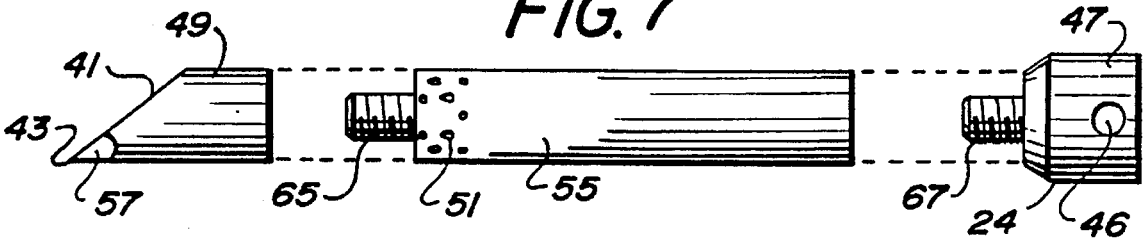
FIG. 7 is a side view of the penetrator of the nozzle assembly of the invention with the penetrator section and mounting or attachment section unscrewed.

In FIG. 7, the embodiment of the nozzle section of the invention as shown in FIGS. 4, 5, and 6 is shown disassembled into the penetrator section 49, the nozzle section 55, and the rear attachment section 21. It will be noted in FIG. 7 that the three pieces or sections 49, 55, and 21 are connected together by suitable threaded connections 65 and 67, respectively, on the nozzle section 55 and on the clevis 47 or attachment section 21. It will be understood that the threaded sections 65 and 67 which are externally threaded sections will be screw fastened into internal threaded sections in the ends, respectively, of the penetrator section 49 and the nozzle section 55.

It is highly desirable that the diameter of a rear portion 54 of the nozzle section 55 in front of the point of connection of the fitting 31 with the nozzle section be somewhat larger than the remainder of the outside of the nozzle section 55. Such oversize section assures that the nozzle section will become wedged in the opening punched out of the bulkhead by the penetrator section 49 so that the nozzle section will remain in the opening during spraying of the quenchant after the extension ram is detached. The tight fit also reduces to a minimum any toxic fumes which may tend to leak backward through the pierced bulkhead. It also reduces to a minimum any leakage of air into the burning compartment which might tend to induce so-called flashover of the fire. As will be seen it is thus very desirable that a fairly even slug of metal be punched from the bulkhead.

Figure 8:
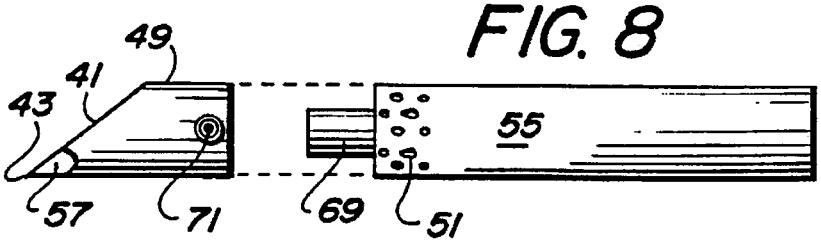
FIG. 8 shows an alternative and somewhat preferred embodiment of the arrangement shown in FIG. 7 in which the penetrator section merely slips over a boss on the nozzle section and may be secured thereto lightly by a thumb screw in the side of the penetrator.

FIG. 8 shows an alternative embodiment of the invention in which a penetrator section 49 is fitted over a non-threaded dowel-like section or boss 69 upon the nozzle section 55. Ordinarily, a threaded set screw or the like 71 in the surface of the penetrator section 49 will be used to clamp or frictionally secure the penetrator section 49 to the section 69 upon the nozzle section 55. This arrangement may be particularly convenient where replacement penetrator sections are used to re-equip the nozzle section for efficient penetration. The use of the screw threads 65 in such case may, in some instances, make it difficult to remove the penetrator section 49 from the nozzle section 55 in order to secure a replacement penetrator section to the end of the nozzle section. It is also difficult with a screw attached section to obtain correct alignment of the penetrator section, the point of which should be exactly downwardly disposed, with the clevis arrangement of the mounting section, which should be horizontally oriented. Furthermore, in a further embodiment of the invention, shown more particularly in FIGS. 14 through 17, the penetrator section 49 will be merely loosely placed over the smooth section or boss 69 in an arrangement which facilitates forceful detachment of the penetrator section from the nozzle section after the nozzle section has passed to the opposite side of the bulkhead 13. In such arrangement, as will be explained later, the force of water sprays behind the penetrator section will act to eject it from the nozzle section as soon as the penetrator section and end of the nozzle section pass through the bulkhead 13 and the water is turned on.

Figure 9:
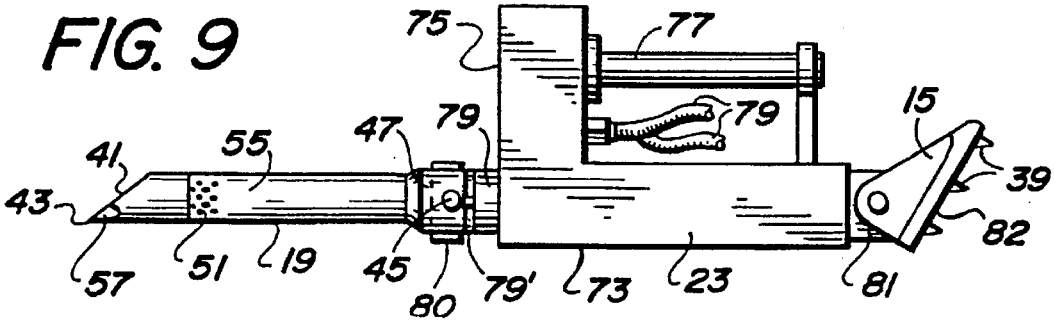
FIG. 9 is a side elevation of the full apparatus system of the invention including a preferred extensible ram apparatus.

FIG. 9 is a side elevation of a known extendible ram unit equipped with the nozzle section and base section of the present invention. In FIG. 9, the ram section 23 comprises a central heavy-duty ram cylinder 73 having basically rectangular dimensions resulting from the fact that it is essentially a hollowed-out steel bar and wherein the additional metal beyond the normal circular circumference provides additional strength and rigidity. At the front of the ram cylinder 73, there is provided a control section or box 75 which contains electronic circuits and controls for precise control of the operation of the ram. Extending backwardly from the section 75, there is a handle 77 for carrying the extendible ram unit, which handle is preferably rotatable and attached by suitable contacts to the control section 75 so that the operation of the ram either forward or back, plus the speed of movement or pump rate, can be precisely controlled by rotational movements of the handle 77. A plug-in, not shown, for remote control is also usually available. A pair of armored hydraulic tubes 78 provide convenient means for reversing the application of the hydraulic fluid to the ram without additional internal ports. The ram cylinder 73 has, extending from the front, a moveable ram 79 which has a suitable end or foot 80 for receipt in the clevis 47 of the nozzle section 19. It will be understood that the inner section of the clevis 47 and the attachment means or foot 80 at the end of the ram 79 will be such that the ram 79 and nozzle 19 are held substantially solidly together so that the nozzle section, or more particularly, the clevis section 47 will not rotate on the end of the ram. It is necessary for there to be a fairly rigid connection between these two units, at least during extension of the ram 79, so that the sharp point 43 at the end of the penetrator section 49 will be forced into the surface of the bulkhead 13 rather than sliding along it. It has also been found with this commercial unit, because of the way the foot is attached to the ram, that a washer 79' provided between the shaft 79 and the foot 80 relieves stress on the connection and decreases breakage.

At the opposite end of the ram cylinder 73, there is a clevis-type fitting foot 81 to which is affixed a base 15 by a clevis-type arrangement as shown in the previous figures with sharp points or teeth 39 extending from its bottom. Such teeth or points may be welded to the bottom or may be screw threaded into the base. As explained above, the sharp points or teeth 39, when pressure is applied to the ram and the unit is in position, forces the teeth 39 down into the deck to stabilize the position of the fire-fighting tool. A stop 82 which forms a portion of the base 15 is preferably angled upon the foot 81 at an angle identical to the angle at which the unit is inclined upon the deck towards the adjacent bulkhead. The large surface area of the stop 82 prevents further penetration after the teeth 39 are imbedded. As explained above, when the angle of the fire-fighting assembly against the deck and the bulkhead are correct, the tooth or teeth 39 and the point 43 will quickly and easily dig into the adjacent deck and bulkhead respectively, preventing these members from sliding along either the deck or the bulkhead. The ram section or unit 23, as shown, is a commercially available ram unit produced and sold by Hurst Emergency Products in Conshohocken, Pa. These hydraulic rams, of which there are several sizes, are sold under the registered trademark "Jaws of Life" for emergency use. Such Jaws of Life® emergency rams have been found very suitable for use with the present invention, although other suitable fluid pressure rams can be used.

FIG. 10 shows an alternative embodiment of the penetrator section 49 in which the flat beveled cutting plane 41 is comprised of a flat carbide or other hard material tip 83 which fits into an underlying seat on the surface of the penetrator section and serves to do the actual cutting. The carbide tip 83 is fastened to the surface of the penetrator 49 by set screws 85. Although not shown, the beveled cutting plane 57 as well as the beveled cutting plane 59, not shown, on the opposite side of the end of the penetrator may be also replaced by a carbide insert to form a replaceable surface. FIG. 11 is a cross section of the end of the penetrator 49 showing the insert 83.

FIG. 12 shows the opposite side of the bulkhead 13 from that shown in FIG. 1 and shows the tip of the penetrator 49 and the upper portion of the nozzle 55 extending from an orifice or hole which has been cut or sheared in the bulkhead plate 13 by the penetrator 49 upon action of the extendible ram. The collection of spray orifices is shown in FIG. 12 about the nozzle section. After an orifice or opening has been cut or sheared in the plate 13, the water may be turned on. However, in FIG. 12 the water has not yet been applied to the nozzle. A curved slug or section of sheared metal 13' derived from the bulkhead plate 13 is shown dropping down after having been sheared out of the plate.

FIG. 13 is a side view of the nozzle 19 extending partially through the bulkhead as shown in FIG. 12 and shows the water sprays 53 extending away from the nozzle in a preferred pattern. It will be noted in particular that the sprays 53A and 53B extend in diametrically opposite directions substantially parallel to the face of the bulkhead 13 even though the nozzle 19 extends through the bulkhead at the angle at which the original ram and nozzle assembly was inclined against the bulkhead. As explained previously, it is highly desirable that the angles of the orifices 51 in the surface of the nozzle section be differentially arranged so that even though the nozzle extends through the bulkhead at an angle, the sprays are arranged from the nozzle section as though such nozzle section was passing perpendicularly through the bulkhead.

FIG. 14 shows an improved version of the nozzle arrangement of the invention in which the penetrator section 49 is loosely held upon a boss or dowel-like section 69 basically as shown in FIG. 8, except that the set screw 71 shown in FIG. 8 is either not present or not tightened. The top of the nozzle section 55 in this instance as a series of orifices 87 in the upper surface 91, as more particularly shown in the end section or view in FIG. 16, through which water sprays 89 may issue, forcefully striking the rear portion of the penetrator section 49 and forcing or thrusting it away from the nozzle section 55 after both the penetrator and the nozzle have breached the plate of the bulkhead 13. In FIG. 14, the penetrator section 49 is shown being expelled from the end of the nozzle section by the water or other quenching agent sprays 89. As shown more particularly in FIG. 16, the water orifices 87 in the upper surface 91 of the nozzle section 55 may be arranged as a cruciform arrangement of four orifices or any other suitable arrangement such as three orifices in a triangular arrangement or the like. After the penetrator section 49 is expelled from the end of the nozzle section 55, the water sprays 89 continue to spray directly out ahead of the nozzle section effectively filling in a possible blank space which may exist when the penetrator section is maintained permanently on the surface of the nozzle section. As will be evident, the orifices 87 in the top surface 91 of the nozzle section 55 may be angled at any desirable angle to fill in the area in front of the angled nozzle.

The bottom of the penetrator section shown in FIG. 15 is similar to the view of the top of the nozzle section shown in FIG. 16 showing the opening 69' in the bottom of the penetrator section into which the extension 69 extends when the two pieces are being used to punch a hole in the bulkhead 13.

FIG. 17 shows a further variation in the construction of the end of the penetrator section in which there is a thin skirt 93 or external flange about the bottom of the penetrator section which seals with the edge of the nozzle section when the penetrator section 49 and nozzle section 55 are placed or forced together. The skirt or external flange must be inset into the surfaces of the penetrator 49 and nozzle 55, as shown, in order not to interfere with passage of these elements through an orifice punched through a bulkhead or the like. Alternatively, a gasket arrangement, not shown, can be used between the two sections. The skirt 93, or alternatively, a gasket arrangement, allows additional water pressure to build up between the two pieces or sections and causes a more certain and also somewhat more explosive detachment of the penetrator section from the nozzle section.

Figure 18:
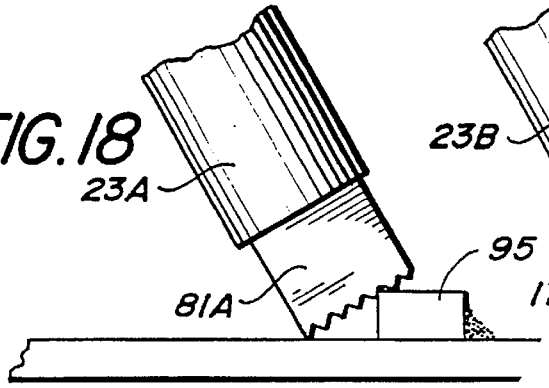
FIGS. 18 and 19 are side views of two alternative manners of stabilizing the base for a ram being used in the system of the invention.
Figure 19:
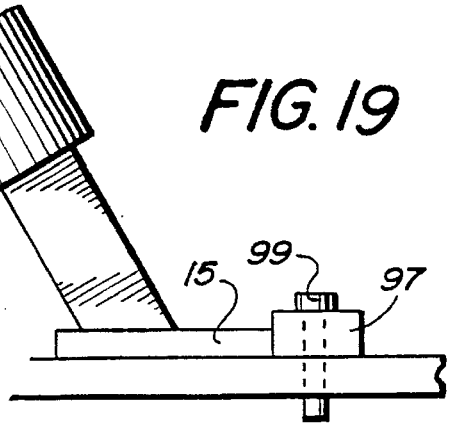

FIG. 18 is a side elevation showing ram section 23A placed upon a deck section 17 at the usual angle for stabilizing the bottom of the base upon the deck. FIG. 19 is a side elevation showing ram section 23B placed upon deck section 17 at the usual angle for stabilizing the bottom of the base upon the deck. In the case of ram 23A, which may be the bottom of one of the Hurst rams, a small section of metal 95 has been quickly welded to the surface of the deck 17 serving as a stop for the foot 81A of the extension ram 23A of the fire-fighting tool. Welding of small sections such as the stop 95 can be accomplished very quickly so that it takes very little or substantially no time and very effectively stabilizes the foot of the ram in a proper position with respect to the deck. It will be understood that in the case of the use of the small stop 95, a base 15 could also be used frequently without the tooth or teeth of the normal base. However, it will also be realized that in certain circumstances, one may wish not only to use the tooth or teeth, but to also reinforce the biting in of the tooth 39 by mounting the stop 95 in the proper position to also support the edge of the base 15. In the case of ram 23B, on the other hand, which is a different form of ram with a short leg on the lower end, a small stop 97 has been secured to the deck 17 by quickly drilling several holes in the deck and placing pins 99 in such holes extending through the stop 97. Again, holes may be drilled in the deck fairly quickly with an electric drill so that only a little time is lost in stabilizing the base of the extension ram in this manner. Drilling, however, may take longer than welding. Only small holes need to be drilled because the main force is taken by the deck, the stop 97 serving only to prevent sidewise or slippage motion, although a pin at least half an inch in diameter may be required to prevent shearing of the pin or pins by the sidewise shear. Also again, the stop 97 which stabilizes the bottom of the ram or the base 15 of the ram can be used with a smooth surface base 15 or with the base shown in previous figures with the tooth or teeth 39 extending from its surface. It will be understood that other methods of stabilizing the base may also be used. For example, a very quick-drying and strong glue or adhesive may be used to attach either the base itself or a stop to the deck quickly. In general, it has been found that the most satisfactory and efficient manners of stabilizing the base or foot of the apparatus upon the deck is by the use of a base such as shown with sharp teeth which bite into the metal deck.

It is always surprising to the uninitiated observer to first see the teeth on the bottom of the base, as well as the top of the penetrator, bite into or enter the metal of the deck and the bulkhead respectively. At the normal angle of the ram and nozzle assembly with the bulkhead and the deck, one would expect to see both the base and the penetrator tip slip. At least one of such units of the fire-fighting assembly would be thought almost surely to be likely to slip along the adjoining plate rather than to bite in. To see both such units therefore, bite into the adjacent metal is initially interpreted as being very surprising and, in fact, almost miraculous.

With respect to the angles of inclination to be used, the inventor prefers the angle of the first beveled cutting plane of the penetrator to be disposed at about 35°, plus or minus perhaps 5° each way, with respect to the surface of the penetrator. To go much beyond these angles is likely to result in excessive fracture of the tip of the penetrator. The penetrator may be hardened steel, or hardened carbon steel, or may comprise a mild tool steel or other suitable material. The particular composition may have some effect upon the best angle for the beveled cutting plane.

The operating angle of the fire tool assembly with the bulkhead and deck will be preferably about 35° with respect to the bulkhead and 55° with respect to the deck and may in each case, be preferably about plus or minus 10° in either direction. With some materials, the preferred tolerance may be greater or less than this. By the laws of geometry, of course, if the bulkhead and deck are 90° to each other, an increase in the angle of the penetrator with the bulkhead will result in an equal decrease in the angle of the base with the deck. The tool may well remain operational beyond these limits, but there will be an increasing chance that the end with the decreasing angle will slip rather than dig into the metal of the bulkhead or the deck, particularly if such metal is particularly hard or slippery.

Figure 20:
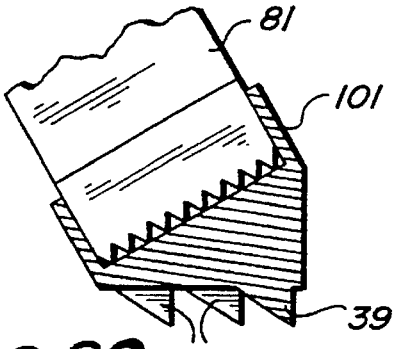
FIG. 20 is a cross sectional side view of an alternative embodiment of a base for the invention.

FIG. 20 shows an alternative version of a base 15 in which a shoe 101 fits over the end of the leg 81 of the ram. The shoe 101 has, in the end, a tooth and/or teeth 39 similar to the teeth shown on the base 15 in other views. Alternatively, the base or shoe 101 can have several teeth 39 of various sizes.

Figure 21:
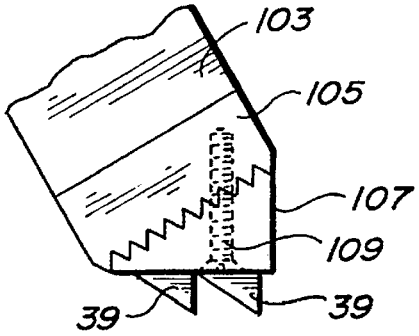
FIG. 21 is a side view of a still further embodiment of a base for the invention.

FIG. 21 shows a still further version of the invention in which a normal foot 103 of the extension ram has a knobbed or knurled end 105, as does the leg 81 in FIG. 20, to which may be attached a small shoe or pedestal 107 by a large diameter set screw 109 or the like. The face of the pedestal 107 will have a matching surface interengaging with the knurled surface of the end 105. The pedestal 107 has extending from the lower end a tooth or teeth 39 as shown in the other views.

Figure 22:
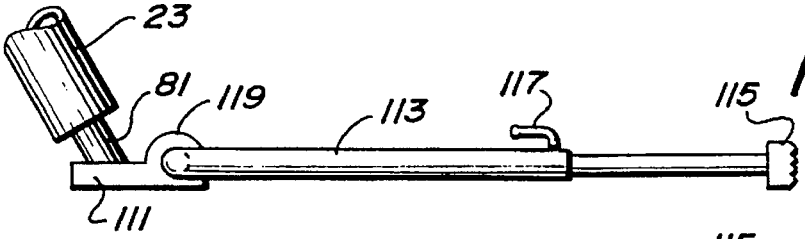
FIG. 22 is a side view of a still further embodiment of a base for the invention in which extension arms provide bracing against an opposite wall or bulkhead.

FIG. 22 is a side view of a further arrangement for a base in which a base member 111 attached to the leg 81 of a ram cylinder 23 may be provided with hinged extension legs 113 which are of a telescoping form having their own bases 115 on the end and a set screw arrangement 117 to control the amount of extension attained from the telescoping. Such telescoping legs may be used where there is a further bulkhead or other object across the deck or at another location on the deck against which the extension legs 113 may be abutted to aid in stabilization of the position of the base upon the deck.

FIG. 23 is a top view of the same arrangement as in FIG. 22 showing the two legs 113 and 113A. As may be seen in FIGS. 22 and 23, the extension legs 113 and 113A may be hinged from the base or otherwise articulated with the base at hinge point 119. It will be understood that the extension legs 113 and indeed the entire structure must be relatively strong in order to resist the strain of stabilizing the base.

Figure 24:
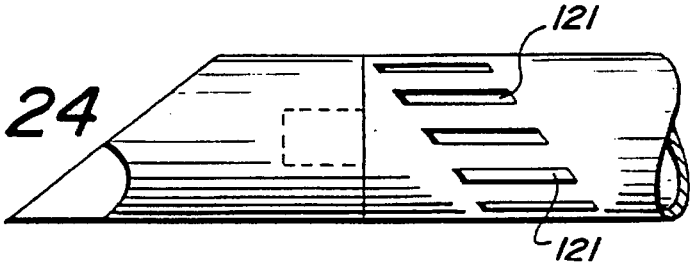
FIG. 24 shows an alternative embodiment of the nozzle and penetrator of the invention.

FIG. 24 shows an alternative embodiment of the invention in which the spray orifices 51 rather than being round as shown in the other figures are instead in the form of slots 121. This may have some advantages in obtaining a very large volume of water sprays directed upon a fire situation. It will be understood, furthermore, that various other spray orifices of various types and shapes may be used. Since it is difficult to precisely direct the pattern of sprays issuing from the slots 121, they are arranged in a slanted pattern upon the surface of the nozzle to accommodate to the angle of passage of the nozzle through the bulkhead.

Figure 25:
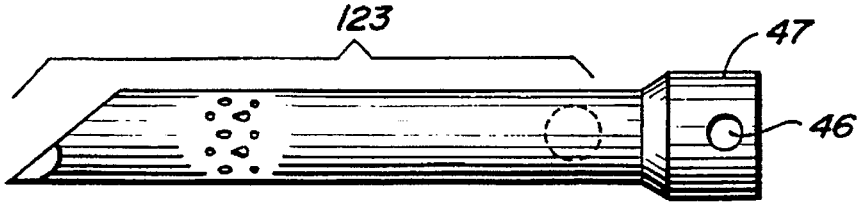
FIG. 25 is a side view of a nozzle assembly in accordance with the invention wherein the penetrator and nozzle are a single unitary construction.

FIG. 25 is a side view of a nozzle assembly in accordance with the invention in which the outer penetrator section 49 and the usual separate nozzle section 55 are constructed from a single metal piece or section and remain as a unitary construction 123. While the arrangement shown in FIG. 25 is less expensive to produce initially, it has the disadvantage of being more difficult and expensive to refurbish after use. It is preferable, therefore, in most cases, to use the three-piece construction secured together by a threaded fitting arrangement or even more preferably by other securing arrangements which may be more convenient to properly align with the rear mounting.

Figure 26:
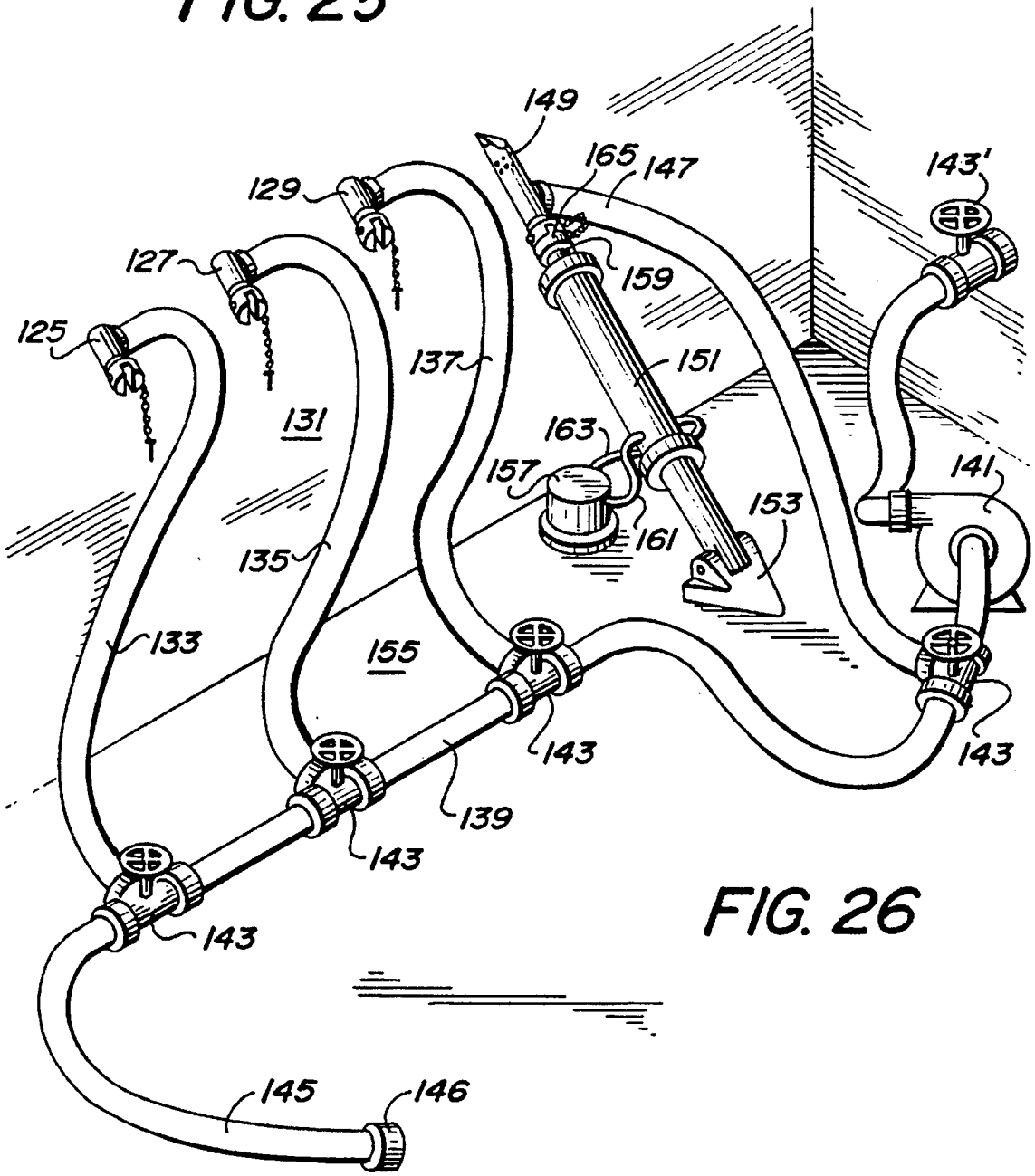
FIG. 26 is an isometric view of a series of nozzle assemblies of the invention already in place in a bulkhead with a further nozzle assembly about to be forcefully thrust through the bulkhead using the same ram. A manifold is shown attached to the various units to direct water to the nozzles as soon as implanted.

FIG. 26 shows a method of using the fire-fighting tool of the invention in which a series of the nozzle portions may be thrust through a bulkhead and left in place with an immediate water connection while other nozzle sections are implanted in the bulkhead by a single ram section. In FIG. 25 a series of nozzle sections 125, 127, and 129 are shown already inserted into or partially through a bulkhead 131 and connected to hose sections 133, 135, and 137. Such hose sections 133, 135, and 137 are connected to a flexible manifold 139 which is connected in turn to a pressure pump not shown, or directly attached to a hydrant 143'. The manifold 139 is provided with a series of three-way valves 143 which serve to shut off the hose sections 133, 135, and 137 as well as hose sections 145 and 147 which are respectively not connected to anything, and connected to a nozzle section 149 connected to a ram 151 which is shown inclined against the bulkhead 131 and resting on a base 153 on the deck 155 in position to be activated by the hydraulic pump 157 to punch a further hole or orifice in the bulkhead 131. As will be understood from FIG. 26, the ram section 151 has been used to punch or thrust the nozzle sections 125, 127, and 129 through the bulkhead 131 as explained and shown previously and is about to be used to thrust the nozzle section 149 through the bulkhead 131. Meanwhile, the hydrant 143' may have been opened and the pressure pump, now shown, operated to provide additional pressure over the ship fire-fighting system, if desirable, whereupon valves 143 leading to the hose sections 133, 135, and 137 can be opened to provide quenching liquid to the nozzle sections 125, 127, and 129. Immediate spray of quenchant liquid beyond the bulkhead 131 can therefore be obtained while further nozzles are being placed in holes in the bulkhead using the single ram 151. The three-way valve 143 leading to the hose section 145, which does not have any fitting attached to it, is not adjusted to allow flow of quenchant liquid into hose section 145. Alternatively, a cap 146 may be provided in the end of the hose section 145. It will be understood, however, that a fitting such as the other nozzle fittings could be attached to the hose section 145. Likewise, hose extension 147 while attached to the nozzle 149 is not providing any water through such hose extension to the nozzle section 149 because the three-way valve 143 associated with such hose extension is closed with respect to said extension in view of the fact that the nozzle 149 has not yet been forced through the bulkhead 131 by operation of the ram 151. In fact, as may be imagined, the ram 151 may still be supported on its base 153 without the teeth of the base being inserted or forced into the deck 155. It will be understood that the hydrant 143' may have either pressurized or unpressurized water available usually from the surrounding ocean and the centrifugal pump, not shown, may, therefore, either be necessary or unnecessary, depending on how much pressure is available and whether any such pressure as may be available needs to be built up to take care of the multiple manifolds. A hydraulic pump 157 is provided to direct hydraulic fluid through either of lines 161 or 163 which are attached to the ram cylinder 151. As will be understood, the hydraulic fluid passes through the lines 161 or 163, depending on whether the ram 159 is extending or being retracted.

Figure 27:
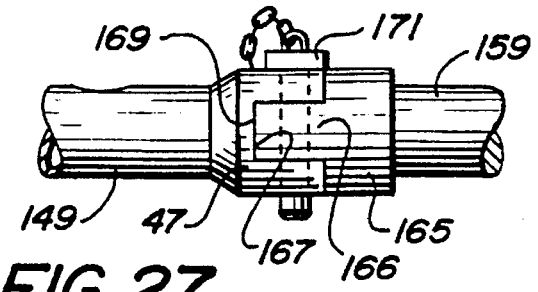
FIG. 27 is a plan view of the mounting clevis of the nozzle assembly attached to the attachment fitting on the end of the extendable ram.
Figure 28:
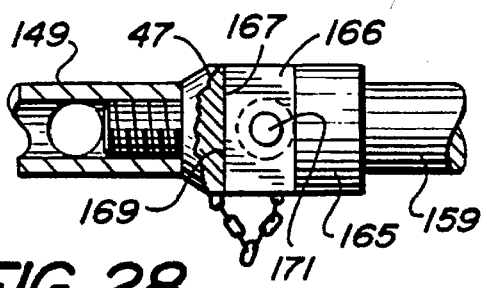
FIG. 28 is a side view partially broken away of the interconnection of units shown in FIG. 27.

FIG. 27 is a side view of the connection of the clevis 47 of the nozzle assembly with the attachment section 165 at the top of the extensible hydraulic ram 159. The attachment head 165 on the extensible ram 159 is provided with a foot 166 having a flat surface 167 which matches with a flat surface 169 at the bottom of the clevis 47. The pin 171 passes through orifices in the two members to secure them together. Even though the foot 166 of the attachment section 165 of the extensible ram 159 has a fairly wide section, the bottom surface of which abuts against the top surface 169 of the clevis 47, the pin 171 should still be fairly tight, not only to keep the two members from separating, but also to form a substantially rigid section, preventing possible fracture of the penetrator section. Under compression, when the extensible ram is moving forward, the foot portion 166 of attachment section 165 of the ram is pressed tightly against the inside surface 169 of the clevis 47, maintaining the two members tightly together and oriented straight with respect to each other. This is also shown in FIG. 28 which is a partially broken-away side view of the interconnection of the two members with the side of the clevis 47 on one side broken away to show the close gap between the top surface 167 of attachment 165 and the bottom 169 of the clevis 147.

Figure 29:
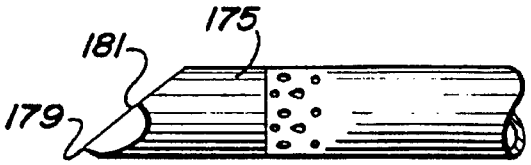
FIG. 29 is a side view of the nozzle assembly of the invention showing use of a further embodiment of the penetration tip of the invention.
Figure 30:
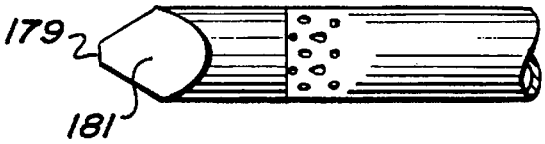
FIG. 30 is a top plan view of the further embodiment of the penetrator tip shown in FIG. 29.

FIG. 29 is a side view of the end of a penetrator section 175 accommodated on a nozzle section. The penetrator 175 has a somewhat different shape from that of the preferred penetrator shown in the previous figures. FIGS. 29 through 32 are various views of the same penetrator. FIG. 30 is a top view of the same penetrator shown in FIG. 29 and FIG. 31 which is a bottom view of the same penetrator shown in FIG. 29. In each of these, there is shown an end section which has a short chisel-type point 179 sloping upwardly into a beveled cutting plane 181 similar to the top beveled cutting planes or faces 41 on the previous preferred pointed penetrator ends and two small relieved beveled cutting planes 183 and 185 on the sides of the bottom of the penetrator end, also similar to the beveled cutting planes 57 and 59 on the previously described penetrator, with a further small downward beveled cutting plane 187 the intersection of which with the top beveled cutting plane 181 forms the chisel-type edge 179. The small chisel point 179 should be short enough so that the available force is not distributed along too long a chisel edge or, in other words, to enable a large degree of the force to be concentrated along a short narrow line or edge. While the embodiment shown is not as resistant to fracture as the embodiment of the tool shown in previous figures, it is broadly usable under the proper circumstances.

Figure 31:
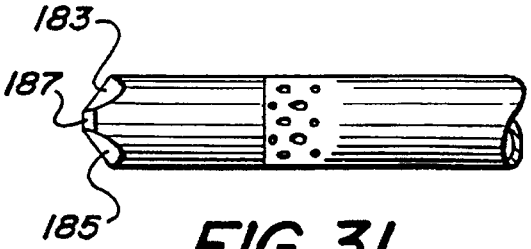
FIG. 31 is a bottom view of the further embodiment of the penetrator tip shown in FIGS. 29 and 30.
Figure 32:
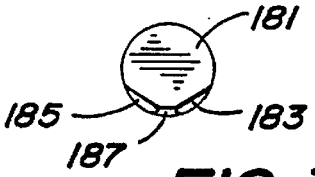
FIG. 32 is a front end view of the further embodiment of the invention shown in FIGS. 29 through 31.

FIG. 32 shows an end view of the penetrator shown in FIGS. 29, 30, and 31. As in the previous embodiment, it is preferable that the edges of the beveled cutting plane 181 be sharp or abruptly change direction. Stroking with a honing stone is effective in maintaining such sharpness and will result in a clean shearing out of an orifice in the plate just large enough for the penetrator and forward portion of the nozzle section to pass through.

One of the prime considerations of the design of the end of the penetrator is not only that the penetrator be able to enter the metal of the bulkhead or other metal through which the penetrator is to be forced, but that as pressure upon the penetrator continues, the metal be opened up and preferably punched out of the plate. While many of the theoretically possible sharp ends of the penetrator will, under the right conditions, enter the metal, it has been found that such ends have a tendency to fracture or completely break off. Immediately upon breakage of the point, further penetration of the penetrator into the metal ceases. Consequently, it is important that the end of the penetrator be both sharp and strong. It has been found that the penetrator point shown in FIGS. 29 through 32 has these properties and is satisfactory for use in the invention, although not quite as efficient or durable as the sharp point on the penetrator shown in the previous views. If the chisel-type point shown in FIGS. 29 through 32 should encounter initial difficulty in entering the metal, a light tap with a cold chisel having the same length will provide a groove in which the chisel point will quickly enter the metal rather than sliding along it. In most cases, the preparation of the surface by marking such surface with another tool as a preliminary step will not prove necessary, however. Nevertheless, as indicated, if necessary, this further step can be carried out. While it is surprising to almost everyone that the penetrator formed with the angles shown and merely applied to the surface at an angle of about 35° will dig into the surface and then breach the entire quarter inch or more of metal bulkhead, it has been found unexpectedly that when operating in accordance with the present invention, this is exactly what happens.

It has been found in addition that when entering the metal at the angle shown in the various figures, i.e., at about 35 degrees with the surface, plus or minus perhaps 10 degrees either way, that it is desirable for the sharp portion of the penetrator to be positioned toward the lower side of the penetrator as shown. Such arrangement, once the initial entrance of the metal is made and particularly with the use of the large beveled cutting plane on the top of the end of the penetrator, tends, it is believed, to direct the punch somewhat downwardly as the piercing of the bulkhead proceeds. This not only discourages sliding of the penetrator point upwardly upon the bulkhead, but as penetration proceeds, minimizes angling of the penetrator upwardly in the direction of one component of the force upon it, which might otherwise tend to cause fracture of the penetrator, and assures that the force of the extendable ram is maintained along the axis of the nozzle assembly which minimizes stress on the penetrator. It also effectively rolls the slug of metal which is being cut from the bulkhead upwardly until it eventually breaks off and falls away, thus aiding in forming an accurately sized orifice with cleanly defined edges in the bulkhead metal. It is necessary in general that the penetrator have an initial sharp section for entrance into the metal, but that the sharp section rapidly increase to more substantial sections to prevent fracture of the end of the penetrator by any transient transverse forces. As will be understood, when piercing a bulkhead under emergency conditions, it is important that there be minimum breakage of penetrator ends which may not only delay access to the fire conditions, but also possibly damage equipment.

When a proper penetrator is used, however, with a nozzle assembly and a hydraulic extension ram, it has been unexpectedly found that an effective penetration of vertical heavy plate such as a bulkhead can be effected using the adjacent deck as a back stop. Since most of the force of the ram is exerted against the deck when the proper angle is used, only sufficient precautions to prevent sliding of the base of the ram, or to stabilize the base, need to be taken. It is surprising to those unfamiliar with the apparatus upon initial observation, both that the penetrator does not merely slide along the bulkhead instead of penetrating it and also that the tool does not break due to the apparent uneven stresses applied to it.

It has also been found that the penetrator pierces the metal more easily and more cleanly at the angle of the invention than is possible when effecting penetration straight through or at right angles to the metal. While the reason for this is not completely understood, it is believed to be related to the fact that when force is applied to metal sheet or plate from the side, the resiliency of the metal, even when very thick, tends to allow the sheet to bend or flex away from the punch or piercing means. This interferes with shearing of the metal and makes the operation more like a stretching and rupture of the sheet rather than a cutting operation. A partial forming or drawing of the metal is effected along with the punching. It also requires a longer movement of the cutting or punching tool. When, on the other hand, the penetrator of the invention enters a metal plate from an angle, the relatively high mass of the metal sections on all sides of the entrance point tends to hold the metal at the point of penetration more rigid, allowing a better cutting or shearing action. The metal is held in pure tension from the bottom and in compression from the top which improves the shearing and, in fact, in the best operation of the penetrator of the invention, once the tip of the penetrator has entered the metal and proceeds through the metal, an actual circular section of metal is usually sheared from the metal plate rather than, as one would expect, rolling up or separating the metal by tearing and shredding as penetration proceeds. The method and apparatus of the invention, therefore, not only effectively pierces the plate, but also does so more cleanly and smoothly and often with less ultimate force and movement of the penetrator than can be accomplished by side or right-angled pressure alone.

It is important that a clean section or cut be made in the bulkhead by the penetrator, particularly when a large diameter penetrator is used, in order to prevent the metal from being turned back or extended by the passage of the penetrator, since any such turning back could cover the spray orifices or otherwise interfere with the efficient spraying of water from the spray orifices. It has been found, as pointed out above, that a clean punch is encouraged by having the edges of the penetrator fairly sharp. This includes the edge of the top beveled cutting plane with the circumference of the shank or circumference of the penetrator. Thus a new penetrator or a used penetrator which has been re-honed will usually punch or shear out a plug or slug of metal from the plate leaving no flared out edges and a clean hole with minimum clearance about the sides. This not only prevents turned outwardly metal from covering the spray orifices, but also minimizes any opening area through which oxygen from the air may reach the fire and minimizes the escape of hot toxic gases through the opening to the fire fighters' side of the bulkhead or wall. Any such admission of air may very easily cause so-called flashover or explosive ignition of all inflammable materials present at one time by radiant emission, if such has not already occurred. The slug of metal punched from the bulkhead when a clean penetration is made is usually in the form of a slightly oblong circular slug turned up on one edge or rolled into a curved section. Such a slug of metal which during testing will be observed to usually drop to the deck in the compartment into which the penetrator enters may be interpreted as a sign of a properly operating fire punch in accordance with the invention. A standard honing stone may be used to hone the sides of the penetrator to renew a used punch to best operating condition.

As indicated above, while the exact reason for the excellent operation of the penetrator at an angle is not conclusively established, it is believed to result from the relatively less resiliency of the metal of the bulkhead itself when force is applied at an angle. The different attack angle or penetration angle with respect to the usually laminar grain structure of the typical rolled plate material may also be a factor.

Figure 33:
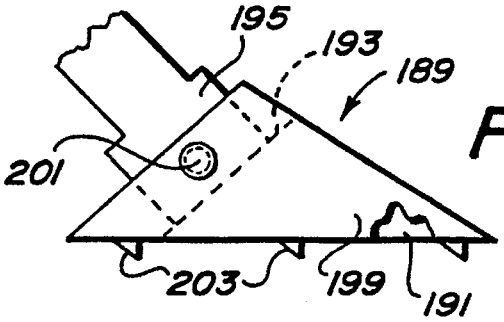
FIG. 33 is a side view of a preferred base in accordance with the invention for stabilizing the leg or bottom of the extensible ram upon a flat surface while maintaining the ram at an angle.
Figure 34:
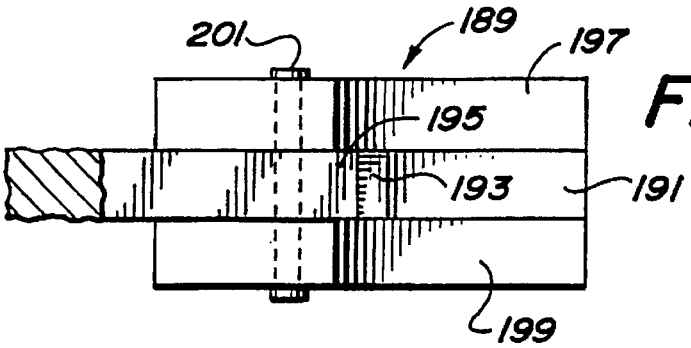
FIG. 34 is a plan view of the embodiment of a base shown in FIG. 33.

FIG. 33 shows a side view and FIG. 34 a top view of a convenient and sometimes preferred base for the bottom of the extension ram. The base 189 is constructed of one or more unequal sided obtuse or obtuse-scalene triangles with the short face of at least the central triangle having the same angle as the angle of the base or leg of the extension ram. Preferably, two other obtuse triangular sections are welded or otherwise secured to the sides of the central obtuse triangular section with an orifice through the two sections through which the bottom of the base of the extension ram may be pinned by a suitable pin 201. The three triangular sections may be formed integral with each other. As described, the central unequal sided obtuse-scalene triangle 191 has a face 193 upon which the base 195 of the ram may be seated. Two other triangular sections 197 and 199 abut the sides of the triangle 191 and provide extensions for an opening through which a pin 201 may pin or secure the base 195 of the ram to the base unit 189. One or more points or teeth 203 extend downwardly from the central base member. These may extend into the deck underneath after pressure is applied. As will be understood, other teeth may also be provided on the bottom of the triangular sections 191, 197, and 199; for instance, on the bottoms of the sections 197 and 199, particularly under the pin 201. The base 189 shown in FIGS. 33 and 34 is particularly useful in combination with the commercial-type ram shown in FIG. 9 which is often provided with its own base, frequently with a knurled surface for use in various environments and particularly for emergency use in bending metal and the like. It is advantageous for the contact surface upon the triangular base in such instance to have a matching face to the knurled face of the ram base, since it has been found that otherwise, at the high pressures used, the knurled surface tends to flatten out and that such flattening action dynamically interferes with the operation of the punching action making it more nearly like punching a sheet or plate of equal thickness perpendicularly rather than at an acute angle in accordance with the present invention. Flattening of the knurled surfaces may also result in snapping or fracture of the base or the tool.

Figure 35:
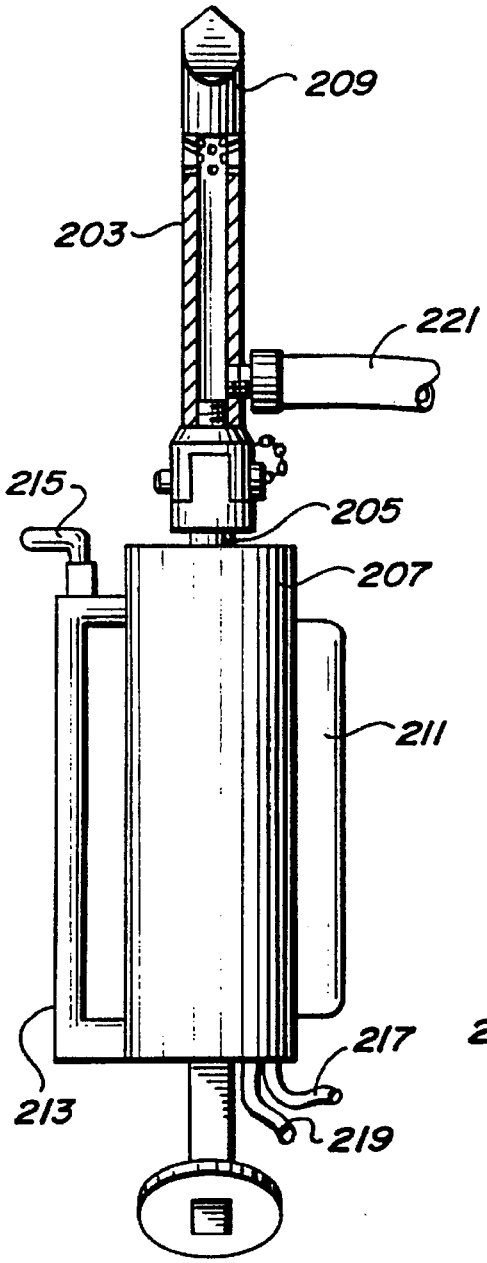
FIG. 35 is a side elevation of a self-contained integral extension ram and nozzle assembly in accordance with the present invention.

FIG. 35 shows a self-contained ram and nozzle arrangement in which the nozzle section 203 is permanently mounted upon the extensible ram 205 which is movable within the ram cylinder 207. One of the penetrator sections 209, as shown in the prior figures, is provided in the top of the nozzle assembly, usually by a screw-threaded arrangement, not shown, but such as shown in the previous views. The ram cylinder 207 is provided with a self-contained reservoir of hydraulic fluid 211 which may partially fit around the outside of the rams cylinder 207. A handle 213 is provided on the opposite side of the ram cylinder 207 and has, at the top, a pivoting valve handle 215. Two hydraulic lines 217 and 219 extend from the self-contained hydraulic fluid reservoir 211 and a fire hose 221 is arranged to connect with the nozzle section 203. It will be understood that the hydraulic lines go to a larger hydraulic reservoir, not shown, which may be associated with the hydraulic pump. Alternatively, a hydraulic pump may be provided as a separate unit or section, not shown, on the side of the ram cylinder 207. This, of course, will make the unit completely self contained.

Figure 36:
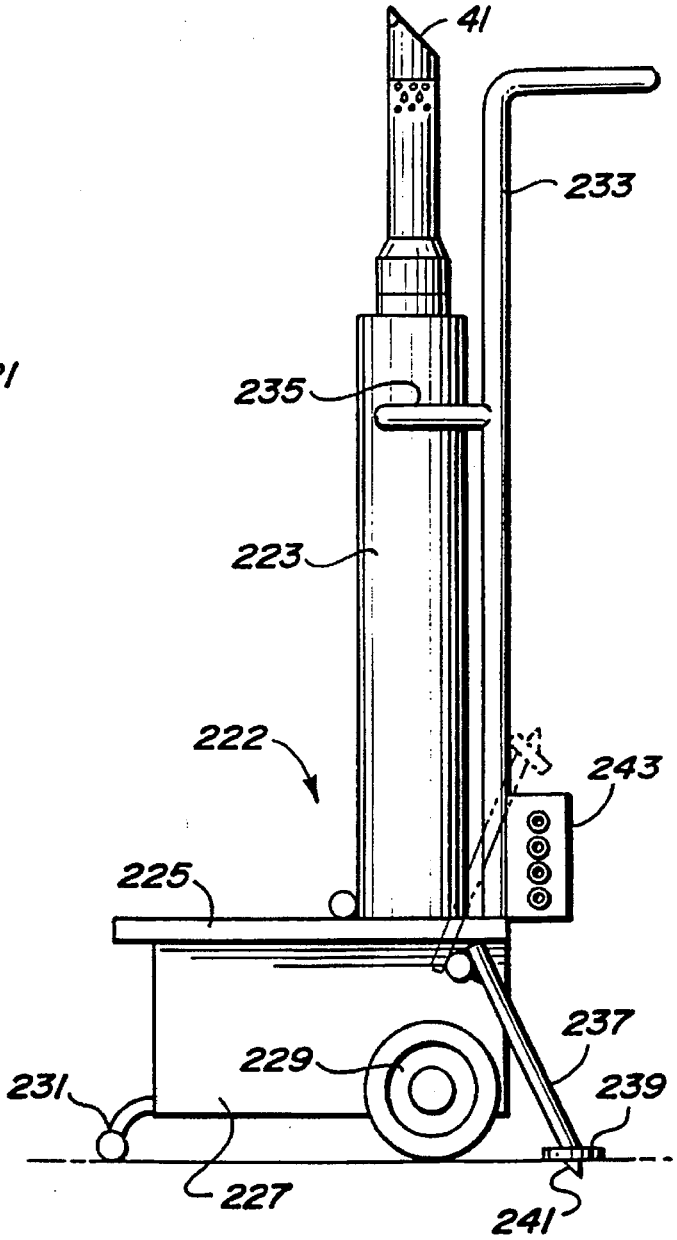
FIG. 36 is a side elevation of a dolly arrangement for transporting and using the fire fighting tool or assembly of the invention.

FIG. 36 shows one of the ram arrangements of the invention, which may be the self-contained ram shown in FIG. 35 or one of the other rams, supported for transport to a fire location upon a doily or hand care 222. The ram assembly 223 is pivotably seated upon a plate 225 supported on a housing 227 within which controls and motors for the arrangement may be housed and transported. A manifold block/control panel 243 is provided for hooking up other equipment. The entire dolly 222 is mobilized by means of the wheels 229. A handle 233 is provided attached to the plate 225 for tipping the entire dolly to the right so it may be wheeled into place. During wheeling, the wheel 231 will be lifted from the surface as frequently accomplished in the use of a hand cart or the like. A clamp 235 is provided to maintain the ram unit 223 upright during transport or upright storage. However, when the unit is wheeled into position in front of a bulkhead which is to be breached in order to inject fire-quenching liquid through such breach, the dolly structure is first located at a suitable point in front of the bulkhead at which position and time, when the hinged extension ram is slanted toward the bulkhead, the tip of the penetrator will rest against the bulkhead at a proper angle for penetration. The proper angle of repose brings the beveled cutting plane 41 at the top of the penetrator section substantially horizontal when the ram unit and nozzle section are established at the correct inclination. The extension legs 237, which are pivoted from the bottom of the plate 225, are then brought down into operative position as shown so that they are resting against the deck with the base 239 disposed substantially horizontally. The extension legs, of which there are two, one pivoted on each side of the plate 225, should be in line with the angle of the ram unit and nozzle. Upon operation of the ram, the teeth 241 of the base 239 will be forced into the deck, while the tires 229 are compressed sufficiently to allow this or, alternatively, springs provided in the bottom of the dolly 222 are compressed to allow the teeth on the base to be forced into the deck. The penetrator section at the top of the nozzle is then forced into the surrounding or adjacent bulkhead and the ram continues thereafter to force the penetrator section through the bulkhead, after which the nozzle section may be disconnected and the ram moved to a new place to operate again with another nozzle section.

Figure 37:
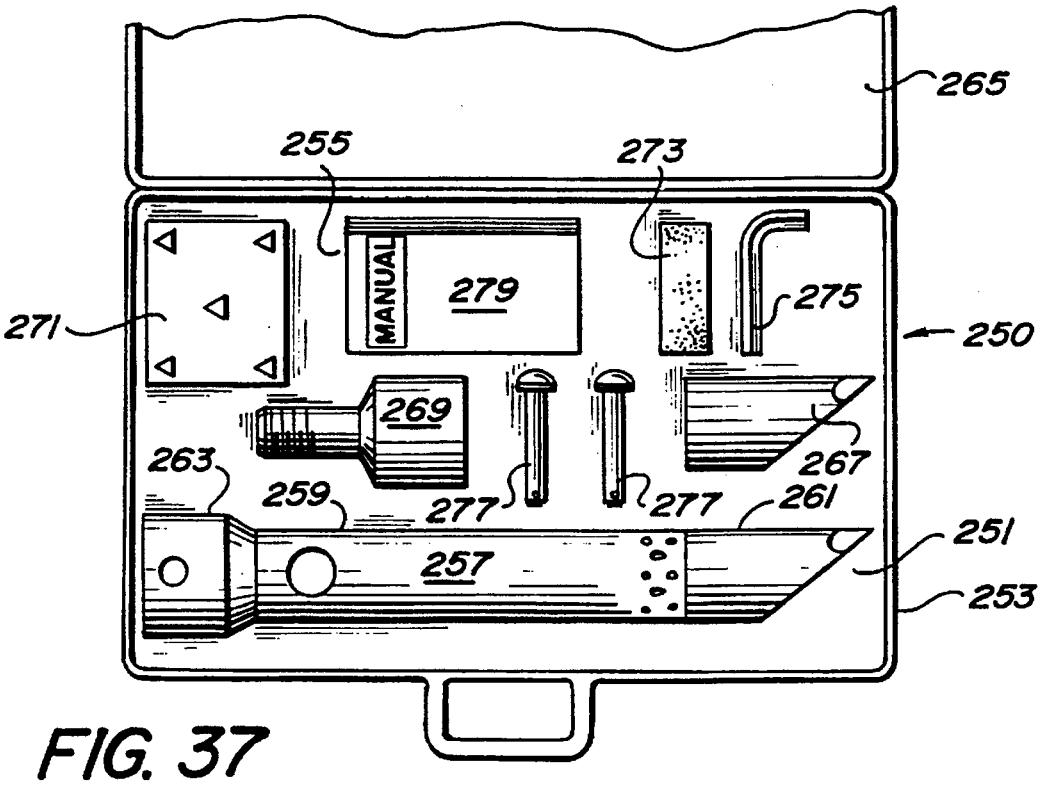
FIG. 37 is a plan view of a kit in accordance with the invention for supplying the necessary elements of the fire-fighting tool for use on an existing fluid pressure ram.

FIG. 37 shows a kit 250 for a nozzle assembly in accordance with the invention for sale and/or storage with emergency equipment. Such kit 250 may comprise either a permanent case or temporary packaging 251 in which the parts of the kit are nested, preferably in suitable openings or depressions for each part. As will be understood, the parts may be nested in molded indentations in the packaging, held in place by clips or clamps or otherwise secured in place or even left loose within the packaging.

The kit preferably includes, as shown in FIG. 37, a bottom panel 253 accommodating molded depressions 255 for the tool parts including a complete nozzle assembly 257 including a central nozzle 259, a penetrator 261, and a mounting or attachment member 263 in the form of a clevis. The nozzle assembly 257 is shown mounted as a single piece or unit in the kit ready to be used upon a moment's notice by mounting upon a separate fluid pressure extension ram. However, it will be understood that the nozzle assembly could be sold in a kit in three separate sections. Also provided in the kit 250, which is also preferably supplied with a top, shown as a hinged top 265, is a replacement penetrator or tip 267, a fire hose reducer or connector 269 for mounting in the quenchant feed orifice of the nozzle section 259, a base 271, a honing or sharpening stone 273 for refurbishing or sharpening a used tip or penetrator, an Allen wrench 275 for detaching the penetrator 261 and mounting a new penetrator, several mounting pins 277 for mounting the nozzle assembly 257 on an extension ram, and a manual 279 covering operation, care, and maintenance of the nozzle assembly. It will be understood that the kit may contain fewer parts than those shown or more or different parts than those shown and may be made in various materials and combinations of parts and materials.

Figure 38:
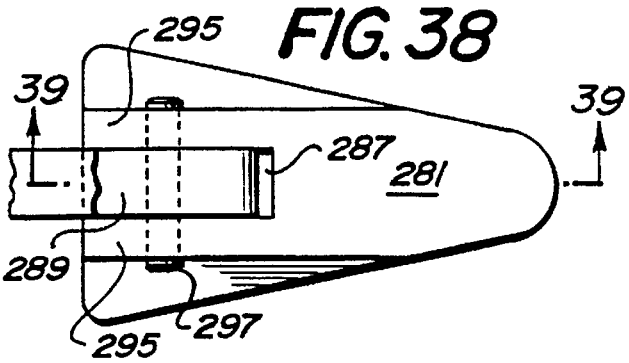
FIG. 38 is a plan view of a preferred base for the penetration system of the invention.
Figure 40:
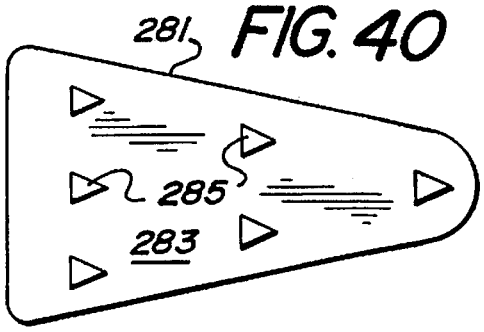
FIG. 40 is a bottom view of the base for the system of the invention shown in FIGS. 38 and 39.
Figure 39:
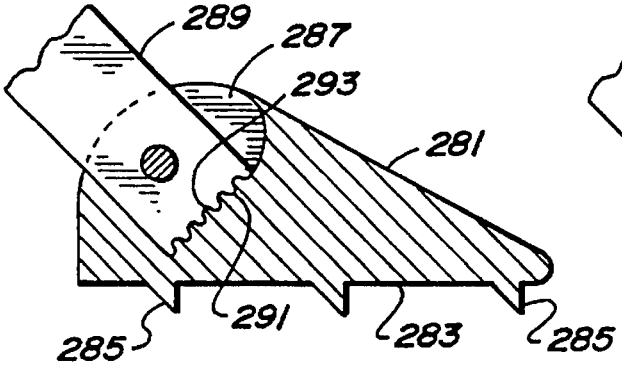
FIG. 39 is a broken-away side view taken upon plane 39—39 of the base for the system of the invention shown in FIG. 38.
Figure 41:
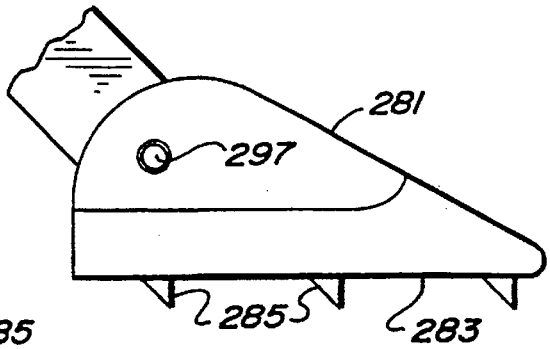
FIG. 41 is a side elevation of the base for the system of the invention shown in FIGS. 38 through 40.

FIG. 38 shows a preferred embodiment of a base for use on a fluid pressure ram when using the nozzle assembly of the invention. In FIG. 39, a base 281 has a flat bottom 283 upon which a series of sharp teeth 285 are spatially arranged at an angle for digging into an underlying surface such as a deck or the like, not shown, for stabilizing the position of the base upon such deck. The attachment end of the base is provided with a slot 287 between a clevis arrangement as shown in FIG. 38 between which clevis the bottom of a ram 289 fits against a surface 291 having a surface configuration which is essentially a mirror image of the knurled surface configuration 293 frequently provided on the bottom of the ram base 289. The clevis sections 295 are shown best in FIG. 38 which is a top plan view of the top of the base 281. The ram leg 289 may be held between the clevis arrangement members 295 by a pin 297. FIG. 39 is a sectional side elevation of the base. Such base can be used not only on the extension ram used with the nozzle assembly of the invention, but also with other types of equipment on the extension ram. FIG. 40 is a bottom view of the base shown in FIGS. 38 and 39 showing the teeth 285 of the base and FIG. 41 is a side elevation of the base shown in FIGS. 38 to 40. As indicated, such base can be used not only with the fire-fighting assembly of the present invention, but in other environments where it may be desirable to use an extension ram inclined at an angle against a floor, deck, or the ground.

While the sharp teeth 285 have for convenience been shown as sharp triangular teeth, it has been found as a matter of convenience and efficiency that the teeth work very effectively if they are designed to be exactly the same shape as the penetrator on the nozzle section. In other words, if the teeth 285 are the same shape with the same angles of cutting surfaces and the like as the penetrator section 49 shown, for example, in FIGS. 4 to 8, piercing or cutting into the deck of the teeth and resulting stabilization of the base 281 upon the deck will be found to be very satisfactory.

As will be evident from the above description, the present invention has provided a method and system by which a fire nozzle may be forced or sheared through a one-quarter inch or thicker plate in the form of a bulkhead on board ship or in some other use. The assembly and penetrator of the invention may also be used in buildings, for use in aircraft accidents, on offshore drill platforms, and the like as well as for bulkhead material thinner than one-quarter inch. The invention, therefore, enables fire-fighting personnel such as a ship's crew or other fire-fighting personnel on land, including municipal fire departments, plant protection personnel in industrial establishments, emergency workers, and the like to breach normally breach-resistant walls in order to spray fire-quenching materials on the opposite sides of such walls into isolated compartments or other spaces where a fire may be burning. The wall is breached by punching out of such wall an opening only of sufficient diameter for the fire nozzle to extend through so that toxic fumes and smoke do not escape to the side of the bulkhead or other wall where the fire-fighting personnel are and so oxygen is not admitted to the compartment where the fire is burning. Since the device of the invention needs only to be leaned against a bulkhead or other wall while supported on its bottom against a deck, floor, or the like, there is almost always a satisfactory surface present upon which the force of the fluid pressure of an extension ram may be exerted in order to force the operative end of the fire-fighting tool through the bulkhead or the like. Quite unexpectedly, the tool does not slip on the surface either on which it is placed or the surface which it is to breach and the tool, although made hollow and having a tremendous amount of pressure exerted against it, does not bend or rupture. The penetrator sections may, in most versions of the tool, be removed and replaced with new or refurbished sharpened penetrators and, during fire conditions, the nozzle sections, once having breached the wall beyond which the fire may be burning, can be hooked immediately to a fire hose and quenchant liquid injected onto the fire, even while the ram unit is being used to force additional nozzle sections through the bulkhead or other wall or surface.

In most cases, the fire quenchant used will be water or sprays of water which is very effective for more fires because of its combined smothering effect and cooling effect derived from its high specific heat and heat of vaporization plus its economy and usual ready availability. However, it will be understood that other fire-fighting agents may be used depending upon the type of fire with which the tool is used. For example, Halon, FREON®, carbon dioxide, water foam as well as other foam, and the like can also be used in place of the usual water sprays.

While the present invention has been described at some length and with some particularity with respect to several described embodiments, it is not intended that it should be limited to any such particulars or embodiments or any particular embodiment, but is to be construed broadly with reference to the appended claims so as to provide the broadest possible interpretation of such claims in view of the prior art and therefore to effectively encompass the intended scope of the invention.

What is claimed is:

1. A base for a fluid-pressure nozzle penetrator-type fire-fighting tool comprising:

(a) a support member having a flat lower surface for surface-to-surface contact with a substantially horizontal support surface, the support member also having an upper surface matching characteristics of a lower surface of a support leg of the fire-fighting tool;

(b) means for securing the support member to the support leg of the fire-fighting tool; and (c) at least one downwardly extending tooth extending from the flat lower surface of the support member for substantially penetrating the support surface to positionally stabilize the support member, (d) wherein the tooth further includes a side disposed at an angle that is the reciprocal of an angle of a beveled cutting plane of a nozzle penetrator section of the fire-fighting tool.

2. A base in accordance with claim 1 wherein the upper surface of the support member matching the characteristics of the lower surface of the support leg of the fire-fighting tool is arranged and constructed to dispose the fire-fighting tool at a 35°±10° angle with respect to a substantially vertical barrier plate structure and at a 55°±10° angle with respect to the support surface.

3. A base in accordance with claim 2 wherein the upper surface of the support member interengagingly matches characteristics of a knurled end of the lower surface of the support leg of the fire-fighting tool.

4. A base for a fluid-pressure activated extension ram for a penetrator-type fire-fighting tool comprising:

(a) a support member having a substantially flat lower surface for surface-to-surface contact with a substantially horizontal support surface, the support member also having an upper surface;

(b) means for securing the support member to a lower portion of the extension ram a top portion of which is adapted to support a nozzle penetrator of the fire-fighting tool having a beveled cutting plane; and (c) at least one downwardly extending sharp tooth on the lower surface of the support member for substantially penetrating the support surface, (d) wherein the sharp tooth further comprises a sharp lower end and a plurality of sides one of which sides is disposed at an angle that is the reciprocal of an angle of the beveled cutting plane of the nozzle penetrator.

5. A base in accordance with claim 4 wherein the upper surface of the support member is arranged and constructed to dispose the extension ram and the nozzle penetrator at a 55°±10° angle with respect to the support surface.

* * * * *